US008651644B2

(12) United States Patent
Kato

(10) Patent No.: US 8,651,644 B2
(45) Date of Patent: Feb. 18, 2014

(54) INK CARTRIDGE

(71) Applicant: Yoshinori Kato, Nagoya (JP)

(72) Inventor: Yoshinori Kato, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 13/804,578

(22) Filed: Mar. 14, 2013

(65) Prior Publication Data

US 2013/0258006 A1 Oct. 3, 2013

(30) Foreign Application Priority Data

Mar. 30, 2012 (JP) ..... 2012-079217

(51) Int. Cl.
*B41J 2/175* (2006.01)

(52) U.S. Cl.
USPC ..... 347/86

(58) Field of Classification Search
USPC ..... 347/84–86
See application file for complete search history.

(56) References Cited

U.S. PATENT DOCUMENTS

| | | | | |
|---|---|---|---|---|
| 7,144,104 | B2 * | 12/2006 | Katayama | 347/86 |
| 7,527,367 | B2 * | 5/2009 | Morita | 347/86 |
| 2012/0162326 | A1 * | 6/2012 | Kobayashi et al. | 347/86 |

FOREIGN PATENT DOCUMENTS

JP 2011-751 A 1/2011

* cited by examiner

*Primary Examiner* — Kristal Feggins
(74) *Attorney, Agent, or Firm* — Fox Rothschild LLP

(57) ABSTRACT

An ink cartridge includes a storage portion, a housing, a movable member, a support portion, and an intermediate member. The storage portion has flexibility and is configured to store ink. The housing that covers the storage portion and at least a central portion of the storage portion is fixed to the housing. The movable member contacts with the storage portion in the housing, and is rotatable in accordance with changes in a position of contact with the storage portion. The support portion is provided in the housing and includes a pair of engagement portions. The pair of engagement portions are disposed at an interval therebetween and rotatably support the movable member. The intermediate member is disposed between the movable member and the storage portion.

11 Claims, 37 Drawing Sheets

FIG. 19

| | | | | |
|---|---|---|---|---|
| FIRST SENSOR | OFF | OFF | ON | ON |
| SECOND SENSOR | ON | OFF | OFF | ON |
| AMOUNT OF INK | FULL | SUFFICIENT | NEARLY EMPTY | EMPTY |

RELATED ART

INK CARTRIDGE

CROSS-REFERENCE TO RELATED APPLICATION

This application claims priority to Japanese Patent Application No. 2012-079217, filed Mar. 30, 2012, the content of which is hereby incorporated herein by reference in its entirety.

BACKGROUND

The present disclosure relates to an ink, cartridge that stores ink.

In general, an ink cartridge is known that includes a generally bag-shaped storage portion (an ink bag) that internally stores ink, a spout through which the stored ink can be drawn out from the storage portion, and a rectangular parallelepiped housing (a plastic case) that houses the storage portion.

SUMMARY

In the above-described general ink cartridge, the housing has an opening through which a needle may pass. The needle may pass through the opening, pierce a rubber plug in the spout, and draw out the ink inside the storage portion. Although a user can visually check the spout through the opening, it may be difficult to visually check and confirm an amount of the ink inside the storage portion.

Here, for example, a movable member that can rotate around an axial center may be disposed such that the movable member is in contact with a side surface in the thickness direction of the bag-shaped storage portion. The amount of ink inside the storage portion may be indicated, due to the movement of the movable member. Specifically, the greater the amount of ink in the storage portion, the more the storage portion expands in the thickness direction, and the movable member that is in contact with the storage portion may rotate in accordance with the amount of ink inside the storage portion. As a result, a rotation position of the movable member can indicate changes in the amount of ink.

However, in this case, a structure to rotatably support the movable member needs to be provided inside the generally box-shaped housing. It is necessary for the support structure to rotatably attach the movable member to the housing that is a separate member, and also to secure the movable member so that it does not come away from the housing after being attached. With a normal support structure, it may be difficult to improve the ease of assembly of the movable member, and thus there is a possibility that this will cause productivity of the ink cartridge to deteriorate. Further, a generally central vicinity of the bag-shaped storage portion is fixed by adhesive to the housing, so that the deformation of the storage portion in accordance with the amount of ink stored inside is not obstructed.

When the ink cartridge with this type of structure is subject to an external impact, such as by being dropped or the like, the ink moves suddenly inside the storage portion due to the impact. For example, when the ink cartridge is dropped and a bottom of the ink cartridge hits a floor surface, the ink inside the storage portion receives the impact from the floor surface and moves suddenly upward due to the imparted force. In addition, when the ink cartridge hits the floor surface in a state n which the housing is inclined, after being dropped straight down, a posture of the ink cartridge is not stable as the housing is thin, and when the housing is inclined etc., the ink inside the storage portion is also subject to a diagonally upward force due to the impact from the floor. When the ink moves suddenly diagonally upward etc. inside the storage portion, a lower end portion of the storage portion may be pulled and is bent upward, and there is a possibility that the lower end portion may become trapped between portions that support the movable member. In this case, the end portion of the storage portion obstructs the movement of the movable member. In such a case, it is possible that the movable member cannot accurately indicate the amount of ink.

Various embodiments of the broad principles derived herein provide an ink cartridge that is able to accurately indicate an amount of ink even if the ink cartridge receives an impact from the outside.

Various embodiments herein provide an ink cartridge that includes a storage portion, a housing, a movable member, a support portion, and an intermediate member. The storage portion has flexibility and is configured to store ink. The housing covers the storage portion and at least a central portion of the storage portion is fixed to the housing. The movable member contacts with the storage portion in the housing, and is rotatable in accordance with changes in a position of contact with the storage portion. The support portion is provided in the housing and includes a pair of engagement portions. The pair of engagement portions are disposed at an interval therebetween and rotatably support the movable member. The intermediate member is disposed between the movable member and the storage portion.

Various embodiments also provide an ink cartridge that includes a storage portion, a housing, a movable member, a support portion, and an intermediate member. The storage portion has flexibility and is configured to store ink. The housing covers the storage portion and at least a central portion of the storage portion is fixed to the housing. The movable member faces and contacts with the storage portion in the housing, and is rotatable in accordance with changes in a position of contact with the storage portion. The support portion is provided in the housing and includes a pair of engagement portions. The pair of engagement portions are disposed at an interval therebetween and rotatably support the movable member. At least one part of the intermediate member is disposed between the storage portion and the support portion, in a direction in which the storage portion and the movable member face each other.

Various embodiments further provide an ink cartridge that includes a storage portion, a housing, a movable member, a support portion, and an intermediate member. The storage portion has flexibility and is configured to store ink. The housing covers the storage portion and includes an inner surface to which at least a central portion of the storage portion is fixed. The movable member contacts with the storage portion in the housing, and is rotatable in accordance with changes in a position of contact with the storage portion. The support portion is provided in the housing and includes a pair of engagement portions. The pair of engagement portions are disposed at an interval therebetween and rotatably supporting the movable member. At least one part of the intermediate member is disposed between the storage portion and the support portion, in a direction that is orthogonal to the inner surface.

BRIEF DESCRIPTION OF THE DRAWINGS

Embodiments will be described below in detail with reference to the accompanying drawings in which:

FIG. 19 is an explanatory diagram of a method for determining the amount of ink by the optical sensors;

DETAILED DESCRIPTION

Hereinafter, an embodiment of the present disclosure will be explained with reference to the drawings.

Outline of Printer

Figure 1:
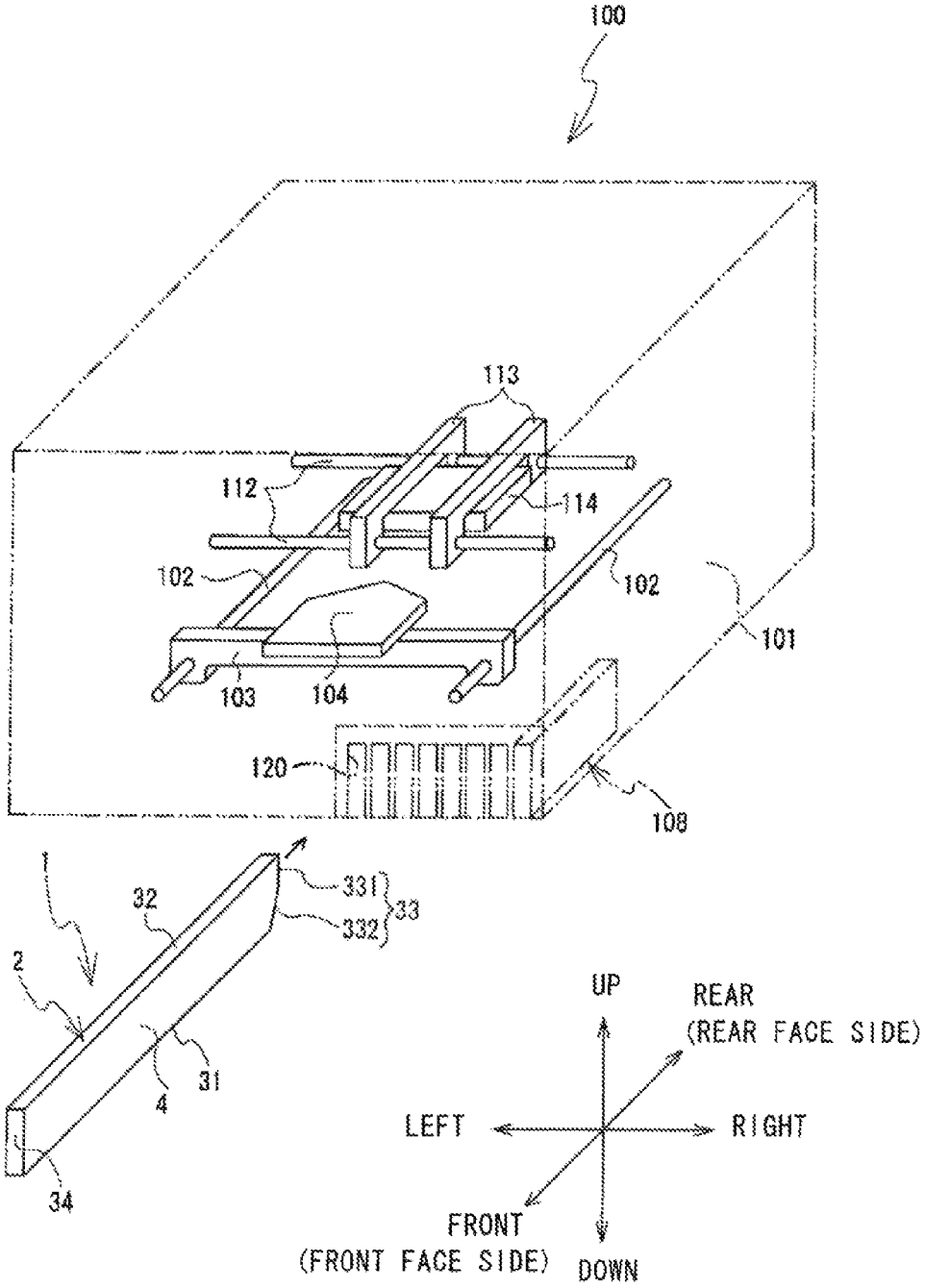
FIG. 1 is a perspective view of a printer as seen from a front side.

A printer 100 according to the present embodiment will be explained with reference to FIG. 1. In the following explanation, the up-down direction, the front-rear direction and the left-right direction of the printer 100 correspond to arrow directions that are shown in the drawings, as appropriate. As shown in FIG. 1, the printer 100 is an inkjet printer that, using a print head 114, performs printing on a cloth (a recording medium), such as a T-shirt or the like, using ink supplied from an ink cartridge 1.

The printer 100 includes a box-shaped housing 101 and a platen 104, the print head 114, a carriage 113, a pair of guide bars 112, a carriage drive mechanism, a platen support base 103, a pair of guide bars 102 and a platen drive mechanism etc. that are each disposed inside the housing 101. The platen 104 is configured to horizontally support a cloth (not shown in the drawings) that is placed on the top surface of the platen 104. The print head 114 is configured to print a character or an image etc. on the cloth, by discharging ink, that is supplied from the ink cartridge 1 onto the cloth that is supported by the platen 104. The print head 114 is mounted on the carriage 113. The guide bars 112 extend in the left-right direction and guide the carriage 113. The carriage drive mechanism includes a carriage drive motor that is not shown in the drawings, and is a mechanism that is configured to cause the carriage 113 to move reciprocatingly in the left-right direction (a main scanning direction) along, the guide bars 112. The platen support base 103 supports the platen 104. The guide bars 102 extend in the front-rear direction and guide the platen support base 103. The platen drive mechanism includes a platen drive motor that is not shown in the drawings, and is a mechanism that is configured to cause the platen support base 103 to move reciprocatingly in the front-rear direction (a direction that is orthogonal to the main scanning direction) along the guide bars 102.

Eight cartridge mounting portions 108 that extend in the front-rear direction are provided in a lower right portion on the front side of the housing 101. A cartridge insertion opening 120 of each of the cartridge mounting portions 108 opens onto the front surface of the housing 101. Note that, in FIG. 1, for the purpose of simplifying the drawing, although the eight cartridge insertion openings 120 are illustrated, only one of the cartridge mounting portions 108 is illustrated. The length of each of the cartridge mounting portions 108 is, for example, approximately one third the length of the ink cartridge 1. When the ink cartridge 1 is mounted in the cartridge mounting portion 108, the ink cartridge 1 is set inside the printer 100 in a state in which ink can be supplied. The ink that is stored inside each of the ink cartridge 1 may be supplied to the print head 114 via tubes inside the printer 100. For example, the eight cartridges 1 may include four ink cartridges 1 for storing white ink, the four ink cartridges 1 for respectively storing four colors of ink, i.e., cyan, magenta, yellow and black ink 1.

Ink Cartridge

Figure 2:
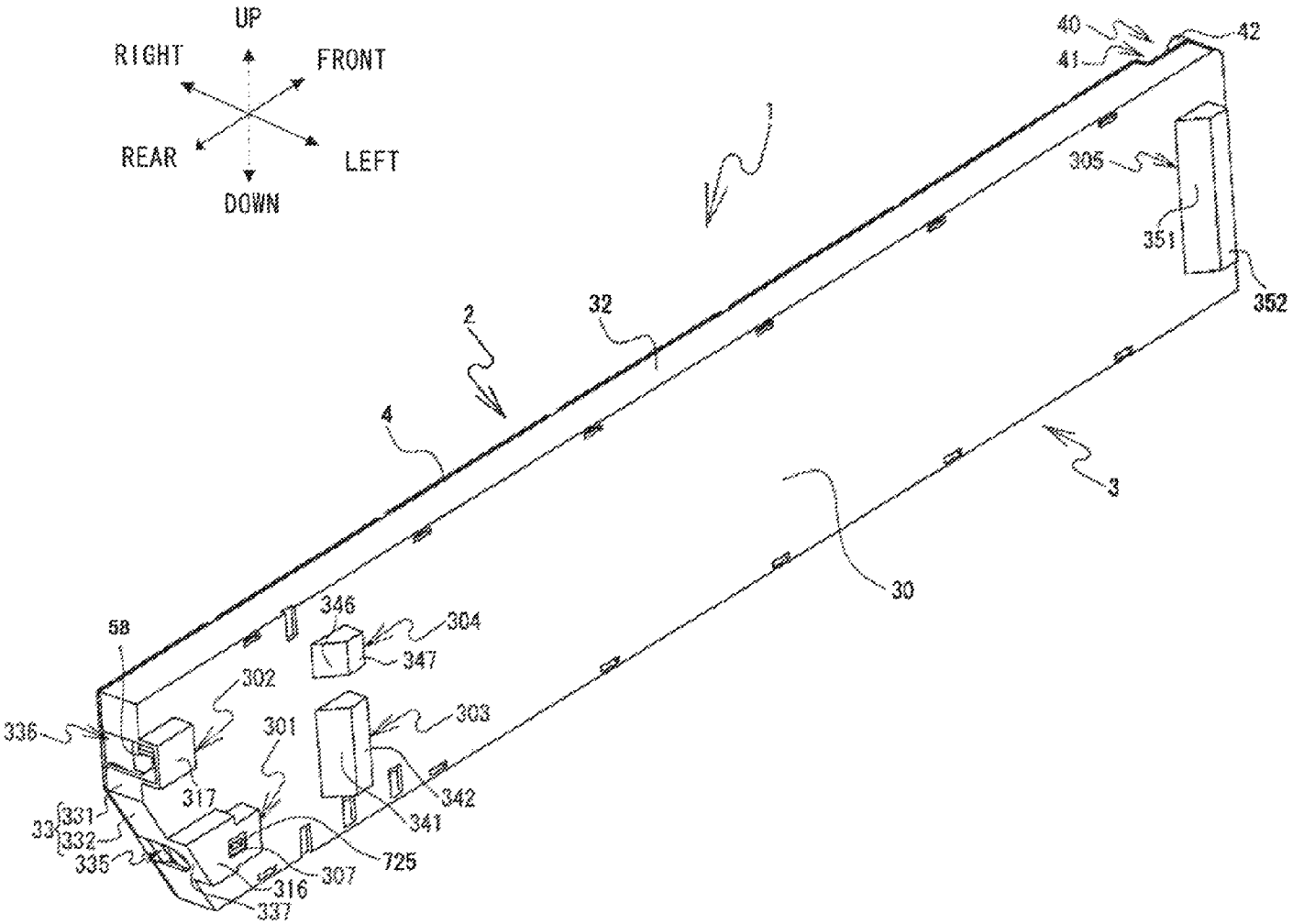
FIG. 2 is a perspective view of an ink cartridge as seen from a rear side.
Figure 3:
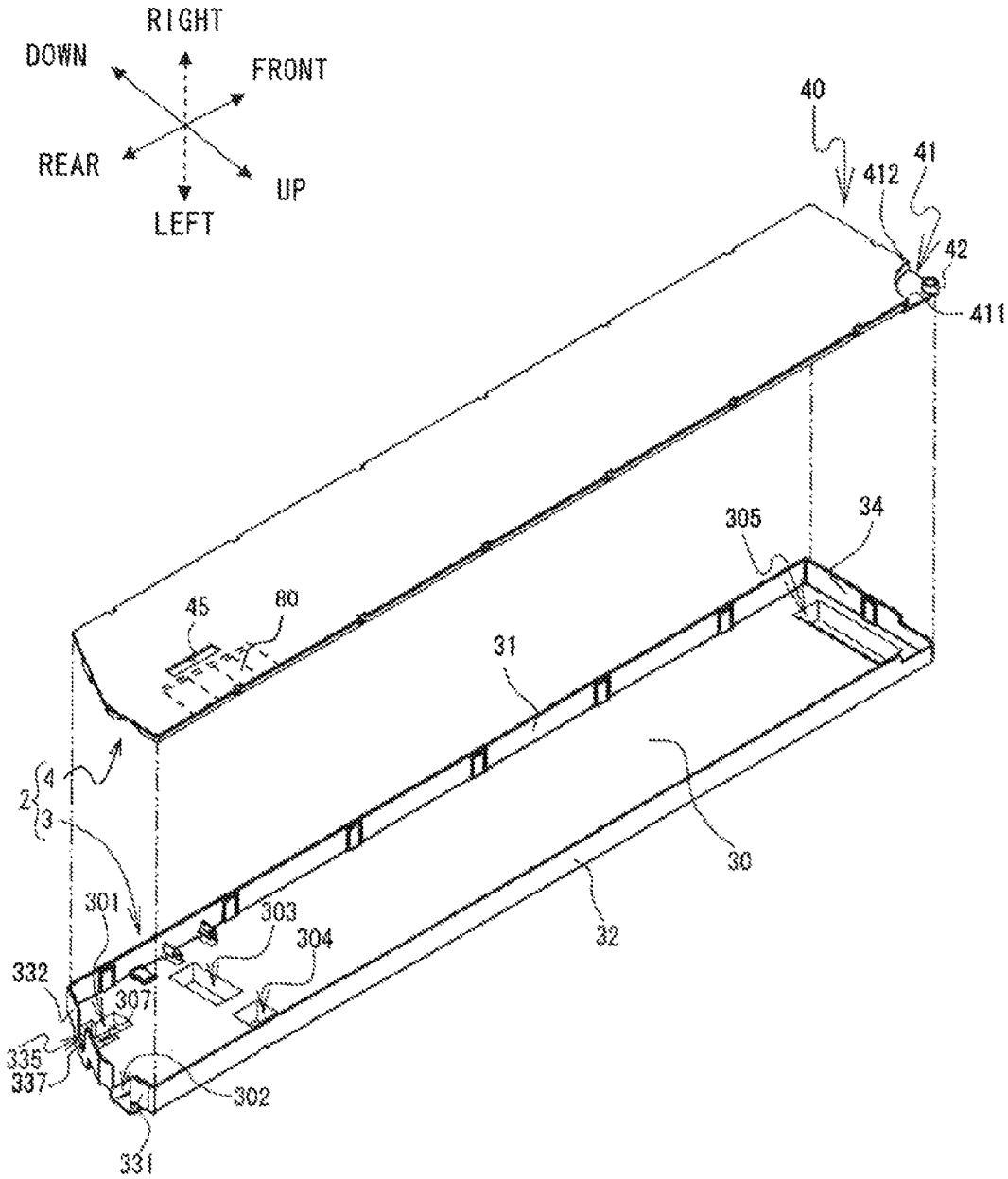
FIG. 3 is an exploded perspective view of a housing.
Figure 4:
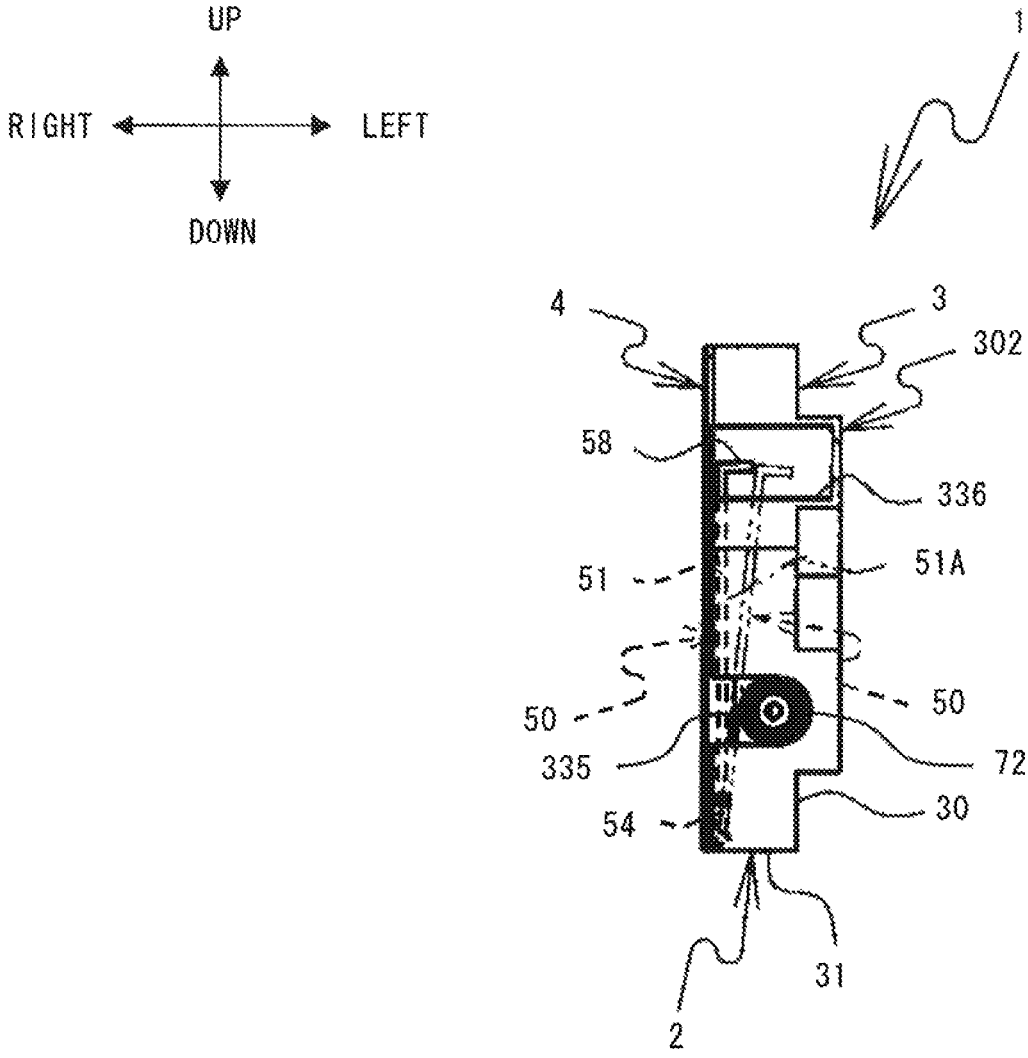
FIG. 4 is a rear view of the ink cartridge.

An overall structure of the ink cartridge 1 will be explained with reference to FIG. 2 to FIG. 6. As shown in FIG. 2 to FIG. 4, the ink cartridge 1 includes a housing 2, an ink pack 7 (refer to FIG. 7) that is housed inside the housing 2, and a detection plate 50 that is disposed inside the housing 2 and that is configured to detect an amount of ink in the ink pack 7 and that is arranged inside the housing 2. The front-rear direction of the housing 2 is the longitudinal direction, the up-down direction of the housing 2 is the short-side direction and the left-right direction of the housing 2 is the thickness (width) direction. The housing 2 has a generally rectangular parallelepiped shape having a narrow width and a longer length in the front-rear direction. In the present embodiment, the ink cartridge 1 is used in a state in which the longitudinal direction and the thickness direction of the housing 2 are generally aligned with the horizontal direction and the short-side direction is generally aligned, with the vertical direction (refer to FIG. 1). Here, generally rectangular parallelepiped means a shape in which the overall outer shape is close to a rectangular parallelepiped. Thus, the housing 2 may include, in places, a surface that is inclined with respect to the above-described longitudinal direction, the above-described short-side direction and the above-described thickness direction, or a portion having a different shape, such as a stepped shape or the like. As will be explained in more detail later, the housing 2 of the present embodiment has a generally rectangular parallelepiped shape that includes an inclined bottom rear wall 332.

As shown in FIG. 3, the above-described housing 2 includes a main body 3 and a lid 4. The main body 3 has a thin and elongated generally rectangular parallelepiped shape. The whole of the right side surface of the main body 3 is open. The lid 4 has an elongated, plate shape that seals the open portion of the main body 3. The housing 2 may be assembled by joining together the main body 3 and the lid 4. A joining method is, for example, a method in which the main body 3 and the lid 4 are joined together using engaging holes and an engaging hooks or engaging holes and engaging pins provided respectively on the main body 3 and the lid 4, or is a method in which the main body 3 and the lid 4 are joined together by welding etc. However, the method for joining the main body 3 and the lid 4 is not limited to these examples.

The main body 3 includes a left wall 30, a bottom wall 31, a top wall 32, a rear wall 33 and a front wall 34. As shown in FIG. 2, the rear wall 33 includes a top rear wall 331 and the bottom rear wall 332. The top rear wall 331 is connected to the top wall 32 and the left wall 30, and extends in the up-down direction. The bottom rear wall 332 is connected to the bottom wall 31 and the left wall 30 and is inclined with respect to the up-down direction. The bottom wall 31 is slightly shorter than the top wall 32 and the rear edge of the bottom wall 31 is positioned such that it is retracted toward the front side of the main body 3. The bottom rear wall 332 inclines to the front side, from the top rear wall 331 toward the bottom wall 31. The top rear wall 331 and the bottom rear wall 332 respectively include a first opening 336 and a second opening 335 for the ink pack 7. As shown in FIG. 4, an indicator portion 58 that is provided on the upper edge of the above-mentioned detection plate 50 faces the first opening 336. A spout 72 that is provided on the rear end of the ink pack 7 faces the second opening 335.

As shown in FIG. 3, on the left wall 30, five protruding portions are provided that protrude from the outer surface of the left wall 30 in the outward direction, namely, a first rear protruding portion 301, a second rear protruding portion 302, a first middle protruding portion 303, a second middle protruding portion 304 and a front protruding portion 305. These protruding portions are formed by recessing the left wall 30 from the inner surface side toward the outer surface side.

The first rear protruding portion 301 has a flat surface portion 316 that is parallel to the left wall 30, and is formed as a protruding portion that is provided contiguously with the bottom rear wall 332. The above-described second opening 335 of the bottom rear wall 332 is formed in a U shape in a sideways direction in the bottom rear wall 332, such that leading end in the protruding direction of the U shape is in a position over the contiguous portion of the first rear protruding, portion 301 and the bottom rear wall 332. A connecting wall portion 337 is provided in the vicinity of the edge of the second opening 335 on the left wall 30 side. The first rear protruding portion 301 is provided, with a rectangular shaped engaging hole 307.

The second protruding portion 302 has a flat surface portion 317 that is parallel to the left wall 30, and is formed as a protruding portion that is provided contiguously with the top rear wall 331. The above-described first opening 336 of the top rear wall 331 is formed in a rectangular shape in the sideways direction, from the top rear wall 331 to the second protruding portion 302. The first middle protruding portion 303 and the second middle protruding portion 304 are provided, such that they are separated in the up-down direction, in positions closer to the rear portion of the left wall 30. The front protruding portion 305 is provided in the vicinity of the front edge of the left wall 30. The first and second middle protruding portions 303 and 304 and the front protruding portion 305 respectively have flat surface portions 342, 347 and 352 that are parallel to the left wall 30, and inclined portions 341, 346 and 351 that are formed on the rear side and that incline gradually toward the rear.

The fiat surface portions 316, 317, 342, 347 and 352 are at a same distance from the outer surface of the left wall 30. When performing an operation such as storing the ink pack 7 in the main body 3, or attaching the lid 4, a user may place the main body 3 on a horizontal flat surface, such as a work table, such that the first to fifth protruding portions 301 to 305 are facing downward, as shown in FIG. 3. In this case, the first to fifth protruding portions 301 to 305 support the main body 3 on the flat surface in a stable manner and thus the user can efficiently perform the operation.

Note that, a positional relationship of the first and second middle protruding portions 303 and 304 indicates a color of the ink. In the present embodiment, in a case where the second middle protruding portion 304 is shorter than the first middle protruding portion 303 and the second middle protruding portion 304 does not cross a band-shaped area extending in the front-rear direction of the housing 2, the color of the ink in the ink pack 7 housed inside the housing 2 is white. The band-shaped area has a width that is defined, in the up-down direction of the housing 2, by distance between a position of a boundary between the top rear wall 331 and the bottom rear wall 332 and a position of the lower end of the second rear protruding portion 302. In a case where the second middle protruding portion 304 is longer than the first middle protruding portion 303, and the second middle protruding portion 304 crosses the above-described band-shaped area, the ink in the ink pack 7 housed inside the housing 2 is one of yellow, magenta and cyan. In this manner, the first and second middle protruding portions 303 and 304 have an identification function that allows the user to identify the color of the ink.

Figure 5:
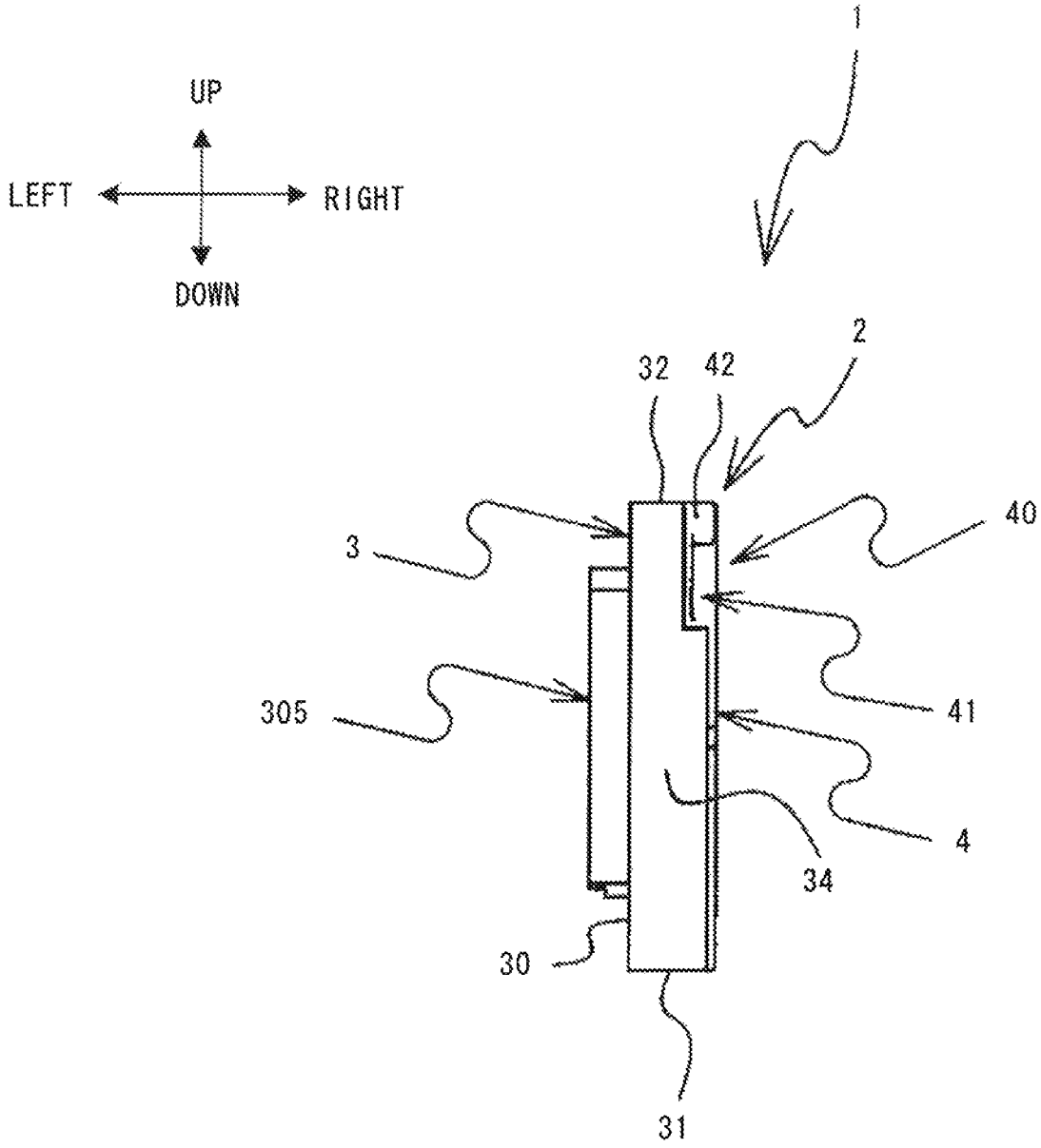
FIG. 5 is a front view of the ink cartridge.

As shown in FIG. 3, a grip portion 40 of the housing 2 is provided on the top front corner portion of the lid 4. The grip portion 40 includes a recessed portion 41 that has a fan shape in a side view, and a protrusion 42. The recessed portion 41 includes a fan-shaped surface portion 411 that has a 90 degree included angle and that is formed by recessing the top front corner portion of the lid 4 from the outer surface side toward the inner surface side, and a peripheral wall 412 of the fan-shaped surface portion 411. The protrusion 42 is provided in the vicinity of the pivot of the fan shape of the recessed portion 41, and protrudes in the opposite direction to the direction in which the recessed portion 41 is recessed. The protruding length of the protrusion 42 is shorter than the depth of the recessed portion 41. As shown in FIG. 3 and FIG. 5, in the top front corner portion of the main body 3, the top wall 32 and the front wall 34 are cut out to receive the recessed portion 41, such that the two sides of the fan shape of the bottom surface of the recessed portion 41 are supported. Even when a plurality of the ink cartridges 1 are mounted in the cartridge mounting portions 108 of the printer 100 such that there is a slight gap between the adjacent ink cartridges 1, the user can securely grasp the ink cartridge 1 and pull the ink cartridge 1 out, by hooking one of his/her fingers that are grasping the two sides of the housing 2 around the grip portion 40.

Figure 6:
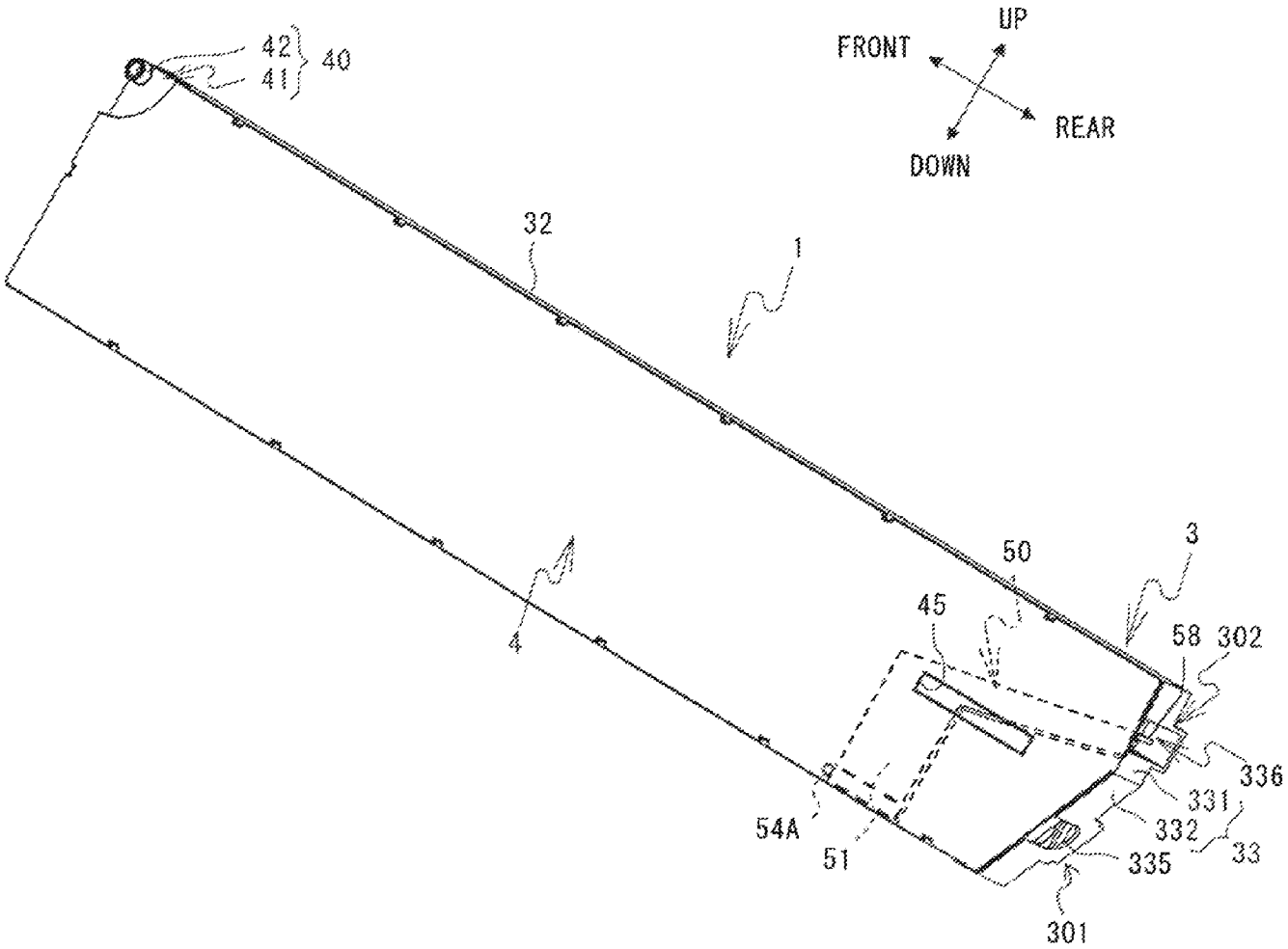
FIG. 6 is a perspective view of the ink cartridge as seen from the rear side.

A visual observation hole 45 is provided in a position closer to the rear portion of the lid 4. The visual observation hole 45 is a through hole having a rectangular shape that is long in the front-rear direction. As shown in FIG. 6, it is possible to visually check the ink pack 7 inside the housing 2 and part of the detection plate 50 through the visual observation hole 45.

Ink Pack

Figure 7:
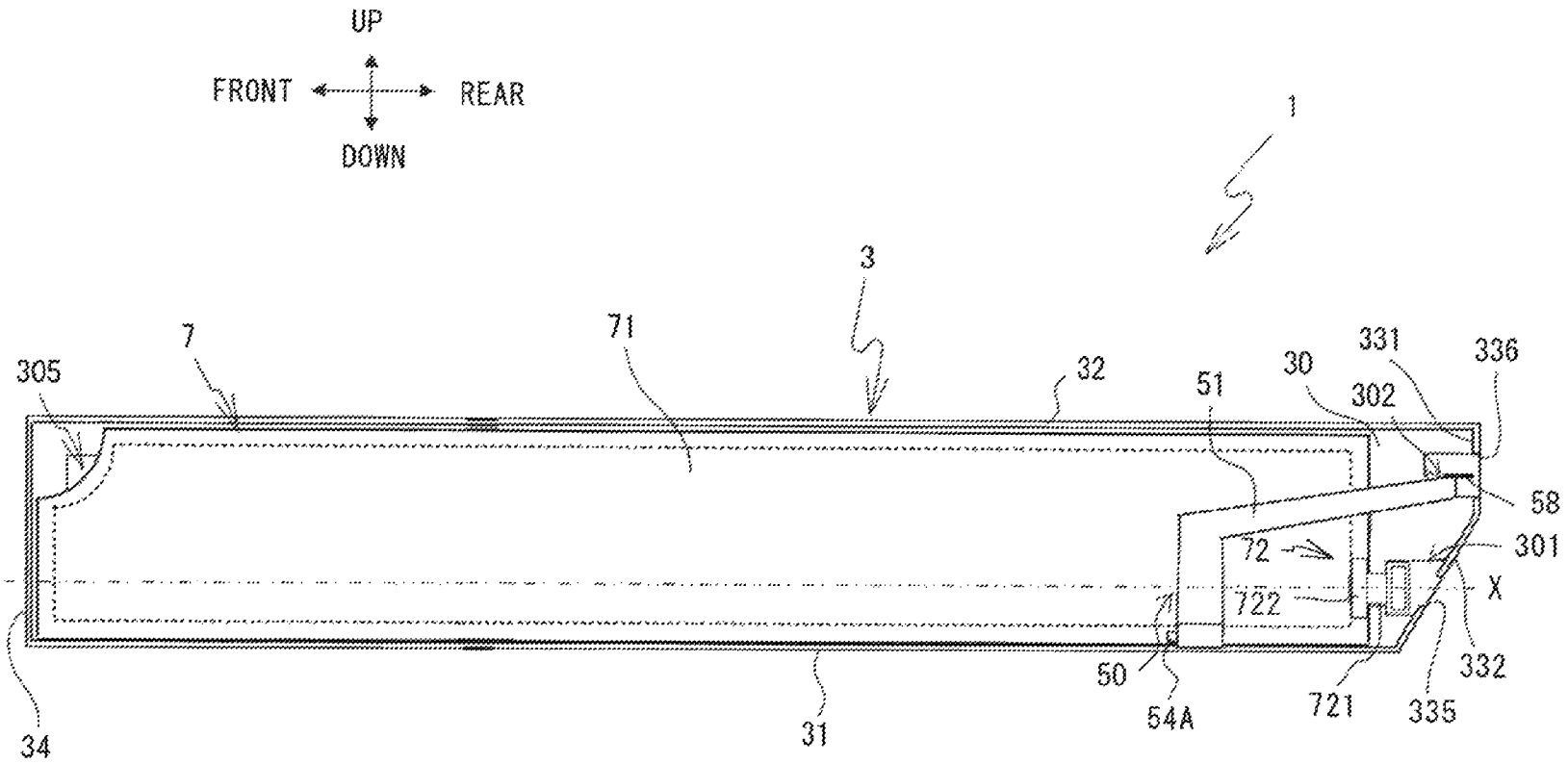
FIG. 7 is a side view showing a main body of the housing in which an ink pack and a detection plate are installed.

A structure of the ink pack 7 and of surrounding portions will be explained with reference to FIG. 7 to FIG. 9. As shown in FIG. 7, the ink pack 7 includes an elongated bag-shaped storage portion 71 that stores the ink, and the spout 72 that is attached to the rear end of the storage portion 71. The storage portion 71 is formed by overlapping two flexible sheets made of transparent plastic and by thermally welding a surrounding portion 716 (refer to FIG. 9) of the overlapped two sheets. The two flexible sheets each have an elongated rectangular shape, and a fan-shaped portion is cut out of the front corner portion of the two flexible sheets such that the cut out portion corresponds to the grip portion 40 of the lid 4. The ink pack 7 is disposed inside the housing 2 such that the surface of the left side of the storage portion 71 on the left side is in contact with the left wall 30.

The spout 72 is made of plastic and includes a cylindrical main body portion 721 and a square column shaped coupling portion 722 that is elongated in the front-rear direction and has a narrow width. The rear portion of the main body portion 721 is formed in a relatively large rectangular block shape. The coupling portion 722 is integrally provided to the front portion of the main body portion 721.

Figure 8:
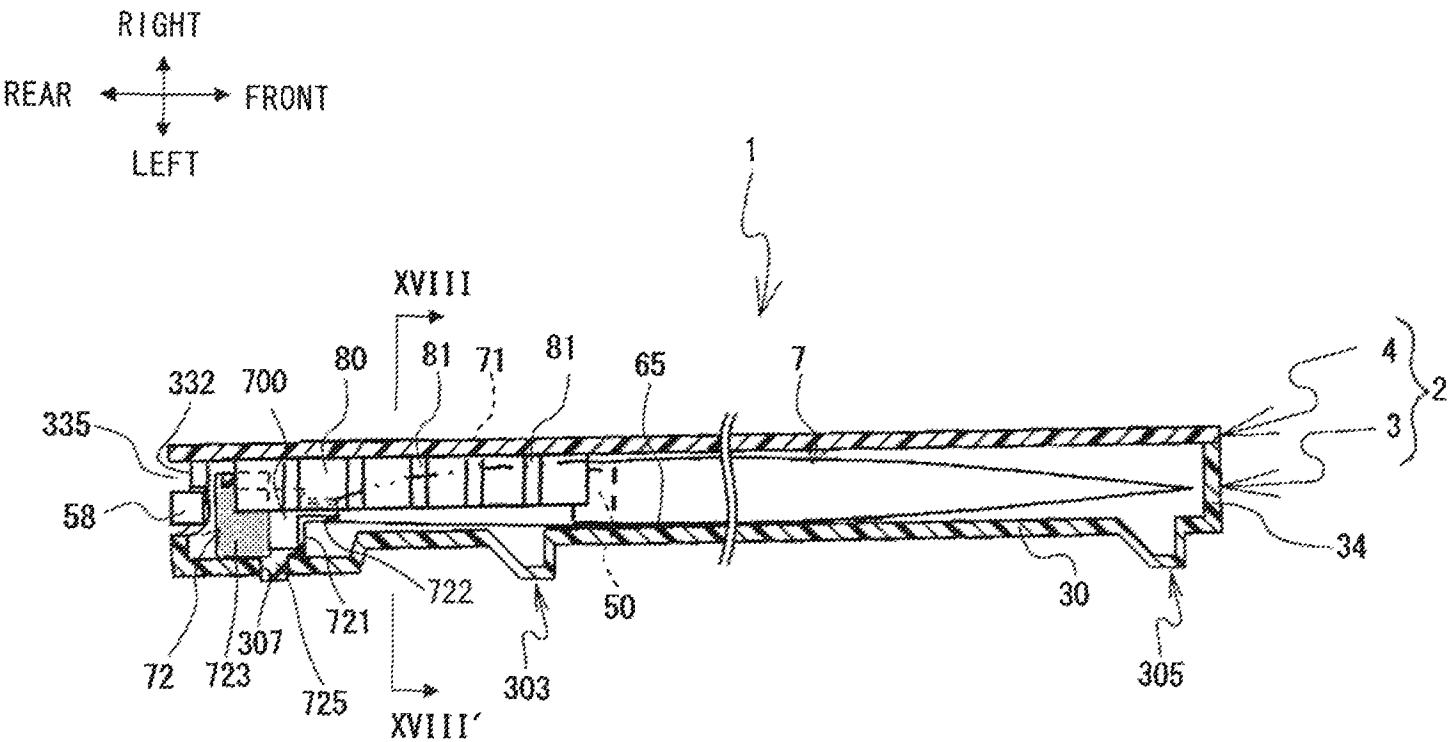
FIG. 8 is a horizontal cross sectional view of the ink cartridge.

As shown in FIG. 8, a hollow portion 700 is provided inside the main body portion 721. The hollow portion 700 is communicatively connected to a narrow hole that penetrates through the coupling portion 722. A rubber plug 723 that blocks the rear end of the hollow portion 700 is fitted into the rear portion of the main body portion 721. At the rear end of the storage portion 71, the coupling portion 722 is inserted in between the two sheets that form the storage portion 71 and is thermally welded together with the sheets. In this way, the spout 72 is fixed in a fluid-tight manner to the rear end of the storage portion 71 in a posture in which an axial direction X (refer to FIG. 7) is aligned with the longitudinal direction (the front-rear direction) of the storage portion 71. A square column shaped engagement protrusion 725 (refer to FIG. 2), which is used to determine the position of the spout 72 with respect to the housing 2 (more specifically, with respect to the left wall 30 of the main body 3), is provided on the peripheral surface of the rectangular block shaped portion of the main body portion 721.

On the lid 4, a rib 80 that inhibits the upper portion of the storage portion 71 from falling over is provided extending above the detection plate 50. Further, reinforcement ribs 81 that reinforce the rib 80 are provided. The rib 80 and the reinforcement ribs 81 will be explained in more detail later.

Figure 9:
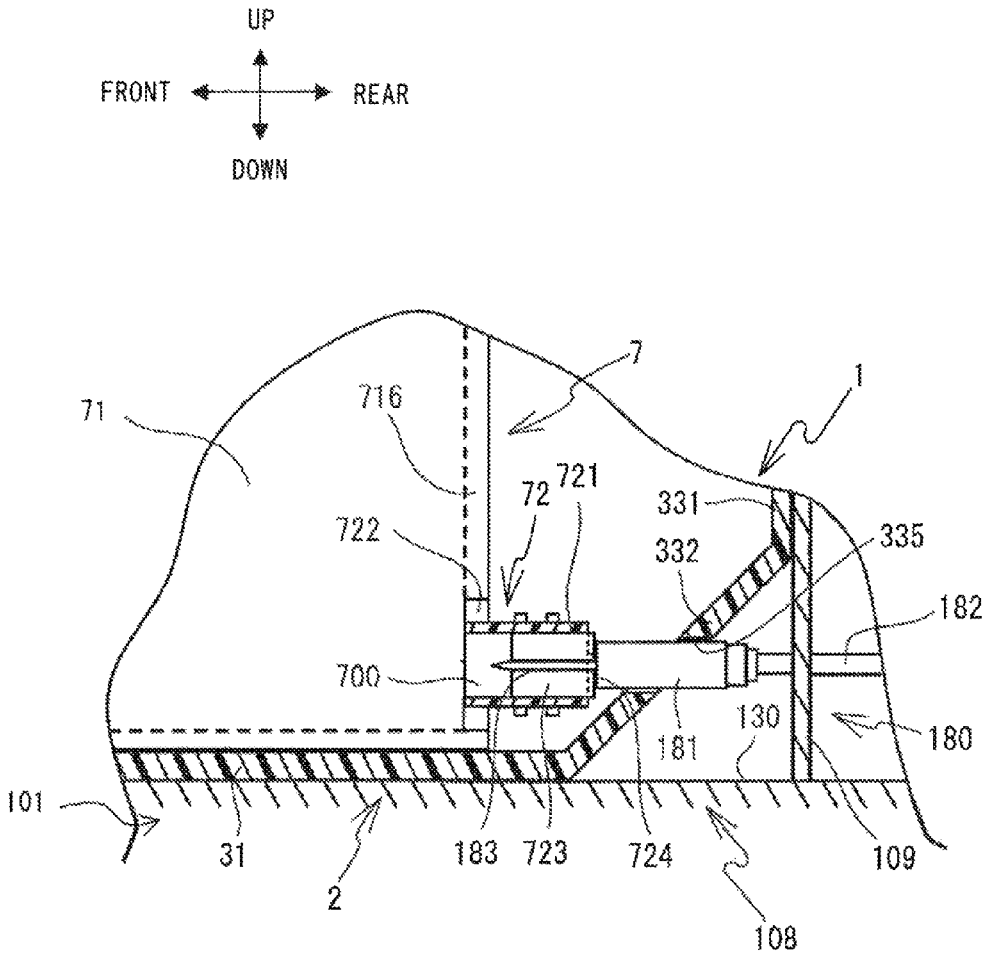
FIG. 9 is a longitudinal cross sectional view of principal parts showing a rear portion of a cartridge mounting portion of the printer.

As shown in FIG. 9, each of the cartridge mounting portions 108 of the printer 100 includes a horizontal placement base 130 on which the ink cartridge 1 may be placed, and a contact plate 109 that rises generally vertically upward from the placement base 130 at the rear of the cartridge mounting portion 108. Further, a connecting portion 180 is provided at the rear end of the cartridge mounting portion 108, in front of the contact plate 109. The connecting portion 180 is fixedly installed inside the cartridge mounting portion 108 such that it is concentric with the spout 72. The connecting portion 180 includes a tubular fixing portion 181 and a hollow conduit needle 183. The rear end of the fixing portion 181 is connected to an ink tube 182. The conduit needle 183 protrudes from the center of the front portion of the fixing portion 181 toward the front, and a hole is provided in the leading end of the conduit needle 183.

The ink cartridge 1 may be inserted into the cartridge mounting portion 108 from the rear portion first, and may be set in the cartridge mounting portion 108 in a state in which the rear portion of the housing 2 is in contact with the contact plate 109. When the ink cartridge 1 is inserted, part of the fixing portion 181 of the connecting portion 180 enters inside the housing 2 from the second opening 335. The conduit needle 183 on the front portion of the fixing portion 181 pierces the rubber plug 723, from a leading end portion 724 of the rubber plug 723 in the spout 72. The conduit needle 183 thus penetrates through the central portion of the rubber plug 723. As a result, the leading end portion of the conduit needle 183 is positioned inside the hollow portion 700 of the main body portion 721. In this way, the storage portion 71 of the ink pack 7 and the ink tube 182 of the printer 100 are connected via the spout 72 and the connecting portion 180. The ink inside the storage portion 71 may be discharged to the ink tube 182 through the hollow portion 700 of the spout 72 and the conduit needle 183 and the fixing portion 181 of the connecting portion 180, and supplied from the ink tube 182 to the print head 114.

Detection Plate

Figure 10:
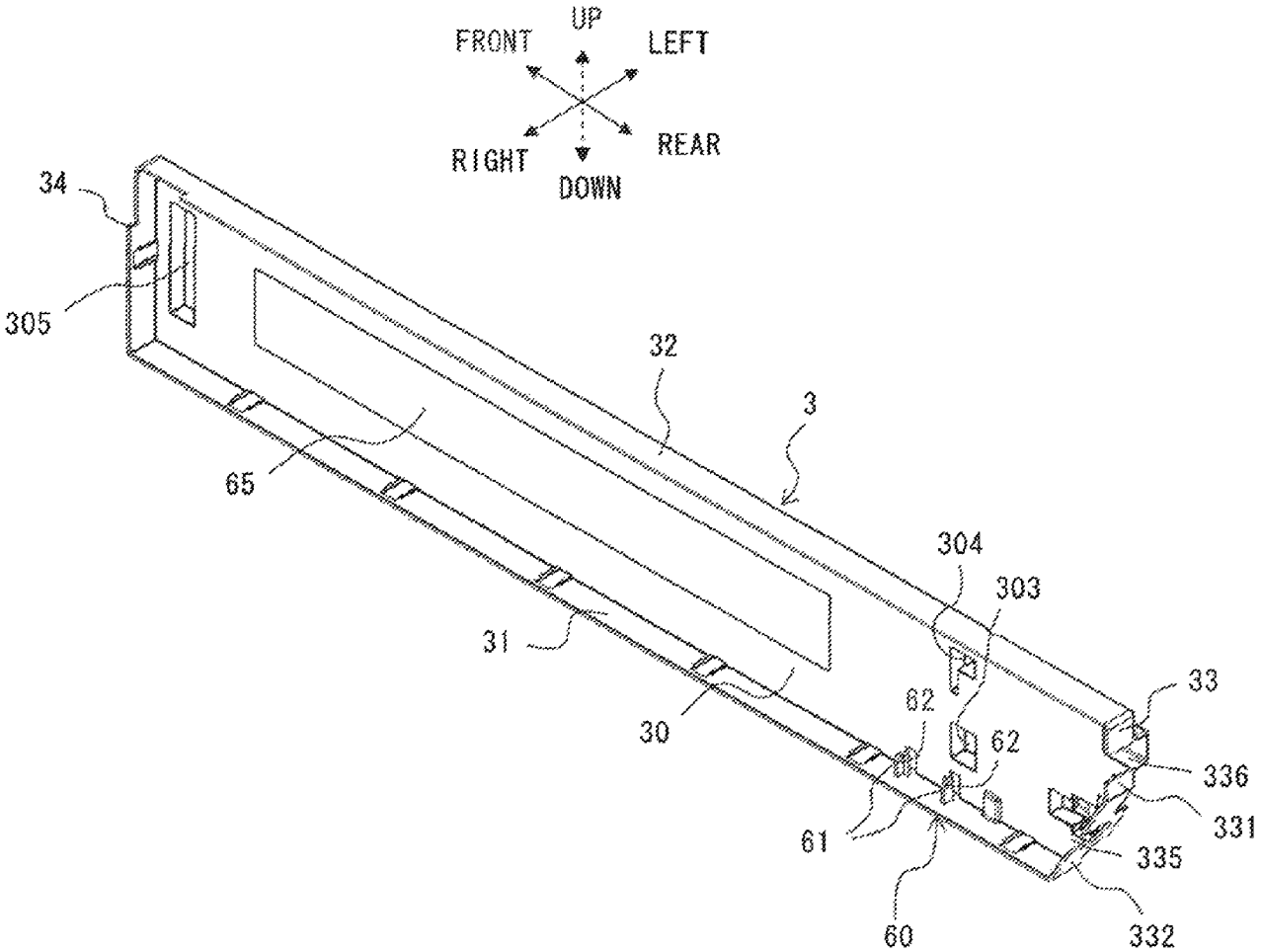
FIG. 10 is a perspective view of the main body of the housing as seen from a rear portion side.
Figure 11:
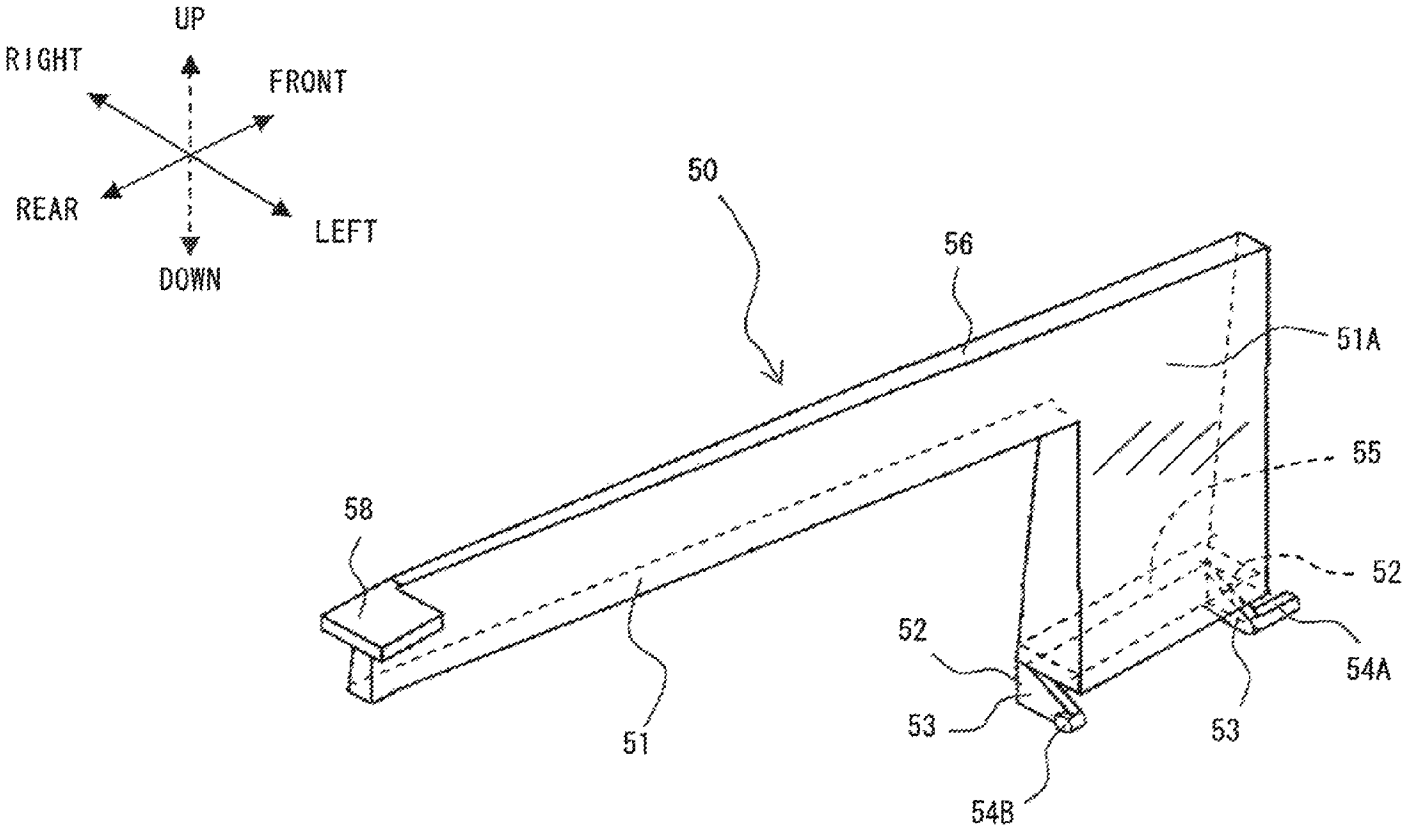
FIG. 11 is a perspective view of the detection plate.
Figure 12:
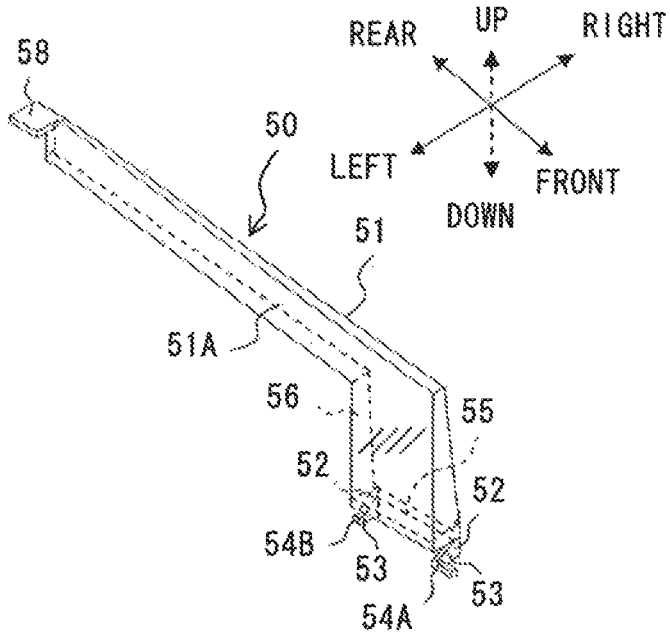
FIG. 12 is another perspective view of the detection plate.

A structure and an attachment state of the detection plate 50 will be explained in detail with reference to FIG. 10 to FIG. 14. As shown in FIG. 10, an adhesion portion 65 such as double-sided tape, for example) is provided on the left wall 30 of the main body 3, on the inner surface of the left wall 30 in a central portion in the up-down direction. The adhesion portion 65 has a band shape extending in a longitudinal direction. The adhesion portion 65 is a portion that contacts with and that is fixed to the left side of the storage portion 71 of the ink pack 7 housed inside the housing 2. An arrangement area of the adhesion portion 65 is positioned outside a range of an arrangement area of the detection plate 50, on the inner surface area of the left wall 30 between the front protruding portion 305 and the first and second middle protruding portions 303 and 304. More specifically, the arrangement area of the adhesion portion 65 is positioned further to the front than the arrangement area of the detection plate 50 that is installed inside the housing 2. A support mechanism 60 that is configured to rotatably support the detection plate 50 is provided in the main body 3 on the inner surface of the bottom wall 31, further to the rear than the arrangement area of the adhesion portion 65 and toward the left side of the housing 2.

The support mechanism 60 includes a pair of front and rear mounting plate portions 61, which are provided with an interval therebetween in the longitudinal direction (front-rear direction) of the housing 2. Engagement portions 62 are provided on the pair of mounting plate portions 61. The engagement portions 62 are configures to engage, respectively, with shaft portions 54A and 54B (protruding portions) that are provided on the detection plate 50. In other words, the pair of engagement portions 62 are arranged having a specific interval therebetween in the axial direction of the above-described spout 72. In the present embodiment, the engagement portions 62 are through holes. However, the engagement portions 62 may be recessed portions that respectively open in a direction facing the protrusion direction of the shaft portions 54A and 54B of the detection plate 50 and that each have a depth that is at least longer than the length of the shaft portions 54A and 54B.

As shown in FIG. 11 to FIG. 14, the detection plate 50 is a generally reverse L-shaped frame that is formed of a material having elasticity (such as plastic). The detection plate 50 includes a contact plate portion 51 a pair of front and rear arm portions 52, the pair of shaft portions 54A and 54B, the indicator portion 58 and a connecting plate portion 55. The contact plate portion 51 is bent into a reverse L shape, and a left side surface 51A of the contact plate portion 51 contacts with the right side of the ink pack 7. The pair of arm portions 52 are arranged on the lower end portion, on the front side, of the contact plate portion 51, with a specific interval therebetween in the longitudinal direction (the front-rear direction) of the housing 2. Each of the arm portions 52 has a support plate portion 53 that extends in the left-right direction. The shaft portions 54A and 54B protrude outwardly from the support plate portions 53 in a direction (the front-rear direction) that intersects with the extension direction (the left-right direction) of the support plate portions 53. The shaft portions 54A and 54B are arranged in a straight line with an interval therebetween. The indicator portion 58 has a flat plate shape and is provided on the upper end and on the rear side of the contact plate portion 51. The connecting plate portion 55 connects the two support plate portions 53, thus firmly supporting the support plate portions 53. Excepting the lower end of the contact plate portion 51, a border frame 56 is provided around the contact plate portion 51. As well as protruding to the left side of the contact plate portion 51, the border frame 56 gradually narrows toward the upper side of the contact plate portion 51. The contact plate portion 51 is reinforced by the border frame 56.

In order to impart a higher degree of elasticity to the arm portions 52, the support plate portions 53 are formed on the arm portions 52 in a generally triangular or generally trapezoidal shape such that the support plate portions 53 expand from left end areas toward right side areas. The right ends of the support plate portions 53 are connected to the contact plate portion 51. The shaft portions 54 are provided on the left end areas of the support plate portions 53. In order to maintain strength at the time of elastic deformation of the arm portions 52, the arm portions 52 are projected even further to the right side from the right end portion of the contact plate portion 51.

Figure 15:
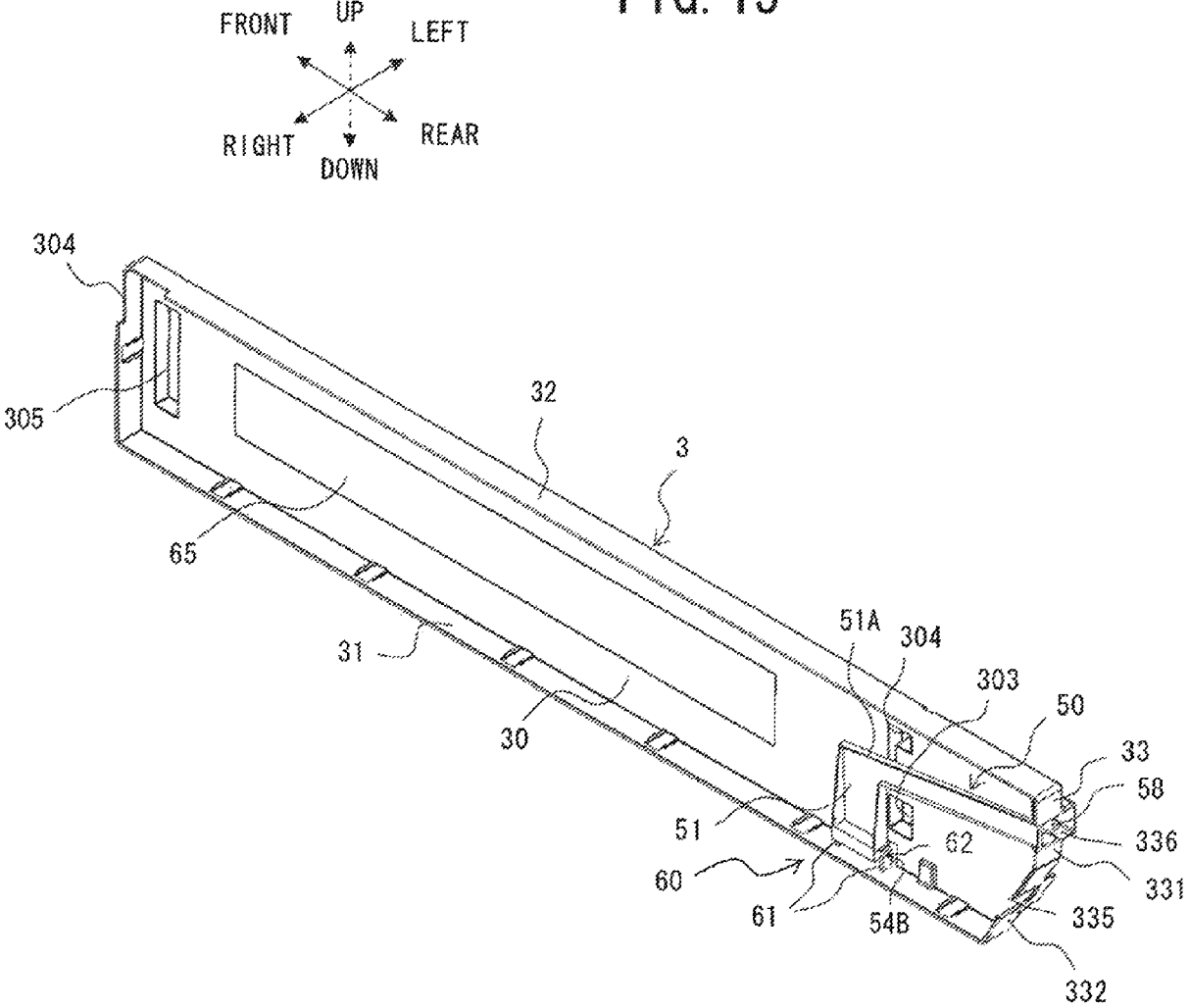
FIG. 15 is a perspective view of the main body to which the detection plate is attached as seen from above and from a left rear side.
Figure 16:
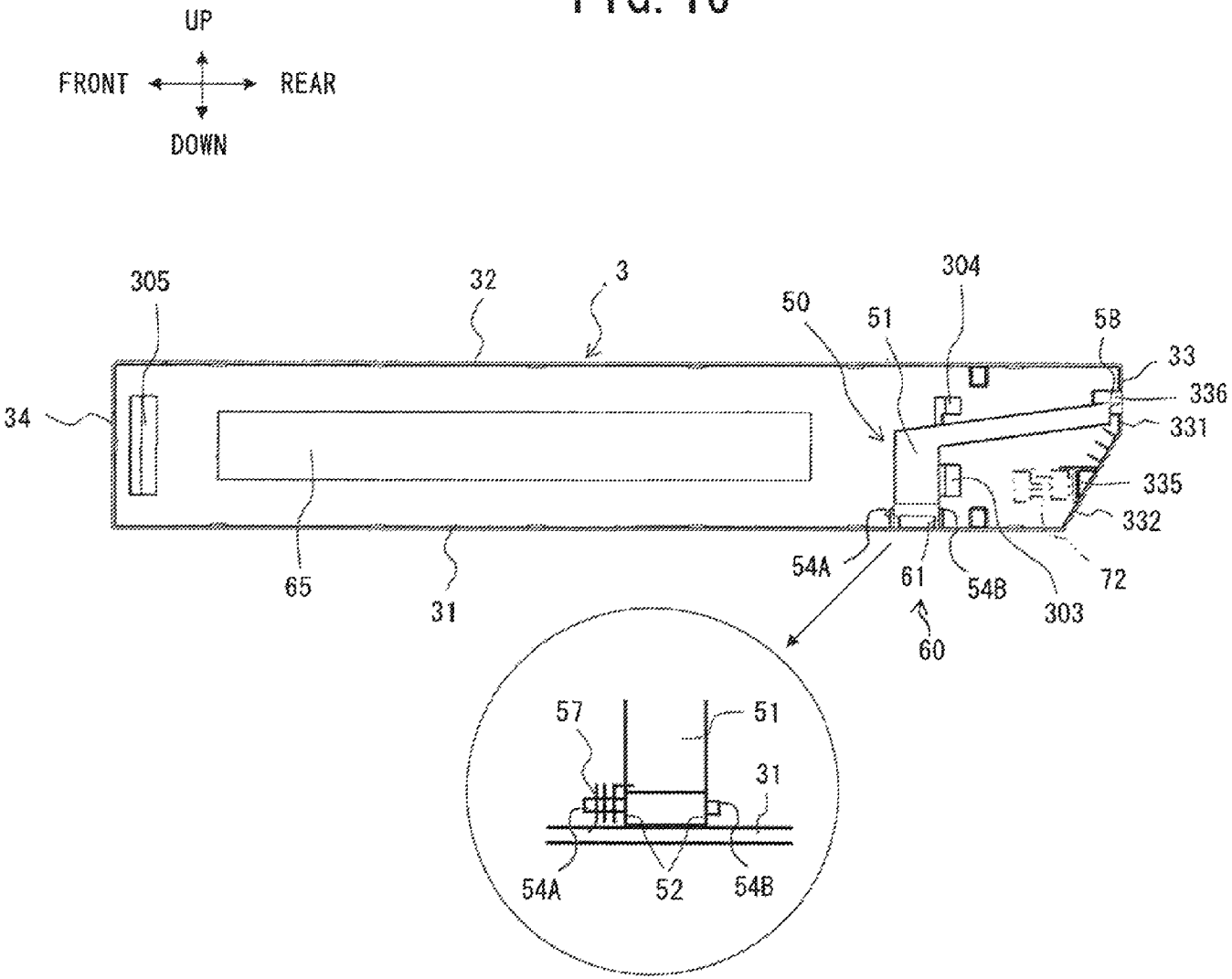
FIG. 16 is a side view of the main body to which the detection plate is attached.

A method for attaching the detection plate 50 to the main body 3 will be explained. As shown in FIG. 15 and FIG. 16, the operator may first arrange the detection plate 50 on the main body 3 in a posture in which the left side surface 51A is facing the left wall 30 of the main body 3. With his or her hand, the operator may apply external pressure to at least one of the two arm portions 52 in the inward direction that is the opposite direction to the protrusion direction of the shaft portion 54 (refer also to FIG. 27). In this way, the operator may arrange the arm portions 52 between the pair of mounting plate portions 61, in a state in which the at least one arm portion 52 is elastically deformed, to an extent at which the engagement portions 62 of the mounting plate portions 61 of the support mechanism 60 do not engage with the shaft portions 54. The operator may stop applying the external pressure to the at least one arm portion 52. Due to the elastic force that occurs when the external pressure is released, the interval between the two arm portions 52 may approach the interval before the deformation, and the engagement portions 62 and the shaft portions 54 may thus engage with each other. In this way, the detection plate 50 can be rotatably installed inside the housing 2, and the shaft portions 54 can be set in positions that include a rotational center of the arm portions 52.

Figure 13:
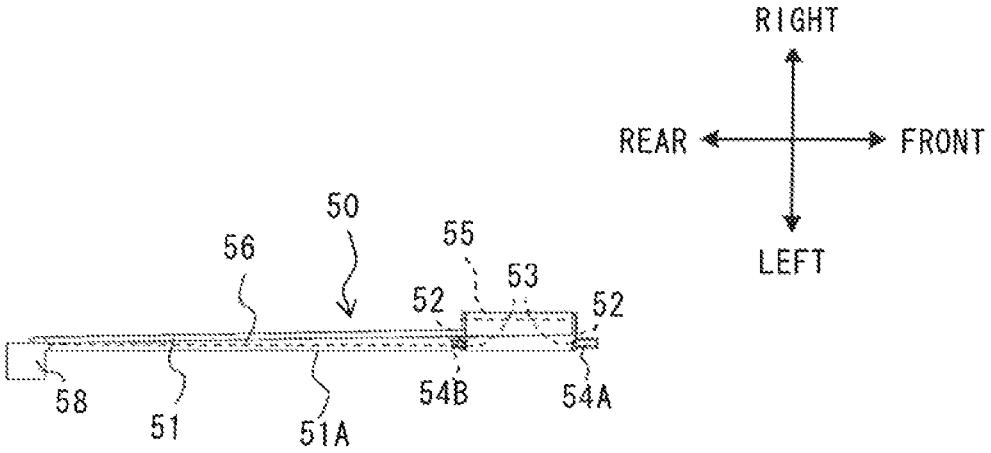
FIG. 13 is a top view of the detection plate.
Figure 14:
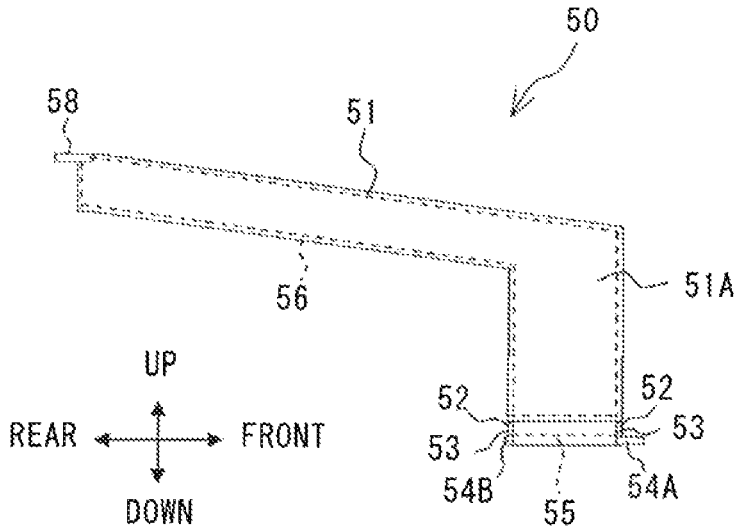
FIG. 14 is a side view of the detection plate.

In the present embodiment, as shown in FIG. 13 and FIG. 14, the protrusion length (the length in the front-rear direction) of the shaft portion 54A, which engages with the engagement portion 62 of the mounting plate portion 61 on the front side, is set to be longer than the protrusion length (the length in the front-rear direction) of the shaft portion 54B, which engages with the engagement portion 62 of the mounting plate portion 61 on the rear side. However, the protrusion lengths of the shaft portions 54 can be reversed from this example, and the shaft portion 54B that engages with the engagement portion 62 on the rear side may be longer than the shaft portion 54A that engages with the engagement portion 62 on the front side.

Of the two shaft portions 54A and 54B of the detection plate 50, a torsion spring 57 is attached to the longer shaft portion 54A, as shown in an enlarged illustration in FIG. 16. Both ends of the torsion spring 57 are fixed to the contact plate portion 51 of the detection plate 50 and the bottom wall 31 of the main body 3, respectively. The torsion spring 57 urges the contact plate portion 51 toward the left wall 30. In this way, the left side of the contact plate portion 51 of the detection plate 50 contacts with the storage portion 71 of the ink pack 7 that is fixed to the adhesion portion 65 of the left wall 30 and housed inside the housing 2. In response to the bulging of the storage portion 71 in accordance with the amount of ink, the detection plate 50 may rotate in the width direction (the thickness direction) of the housing 2 around the shaft portions 54.

As shown in FIG. 15 and FIG. 16, in a state in which the detection plate 50 is installed inside the housing 2, the indicator portion 58 is inserted through the first opening 336 of the top rear wall 331 of the main body 3. The indicator portion 58 protrudes into the first opening 336 from the end (the top end) of the detection plate 50 on the opposite side to the arm portions 52. The indicator portion 58 has a flat plate shape that extends inside the first opening 336, in the front-rear direction and the width direction (the thickness direction) of the housing 2. Due to the rotation of the detection plate 50, the indicator portion 58 is displaced, inside the first opening 336, in a generally horizontal direction in the width direction (the left-right direction) of the housing 2 (refer to FIG. 4 and FIG. 8).

Detection of Indicator Portion

Figure 17:
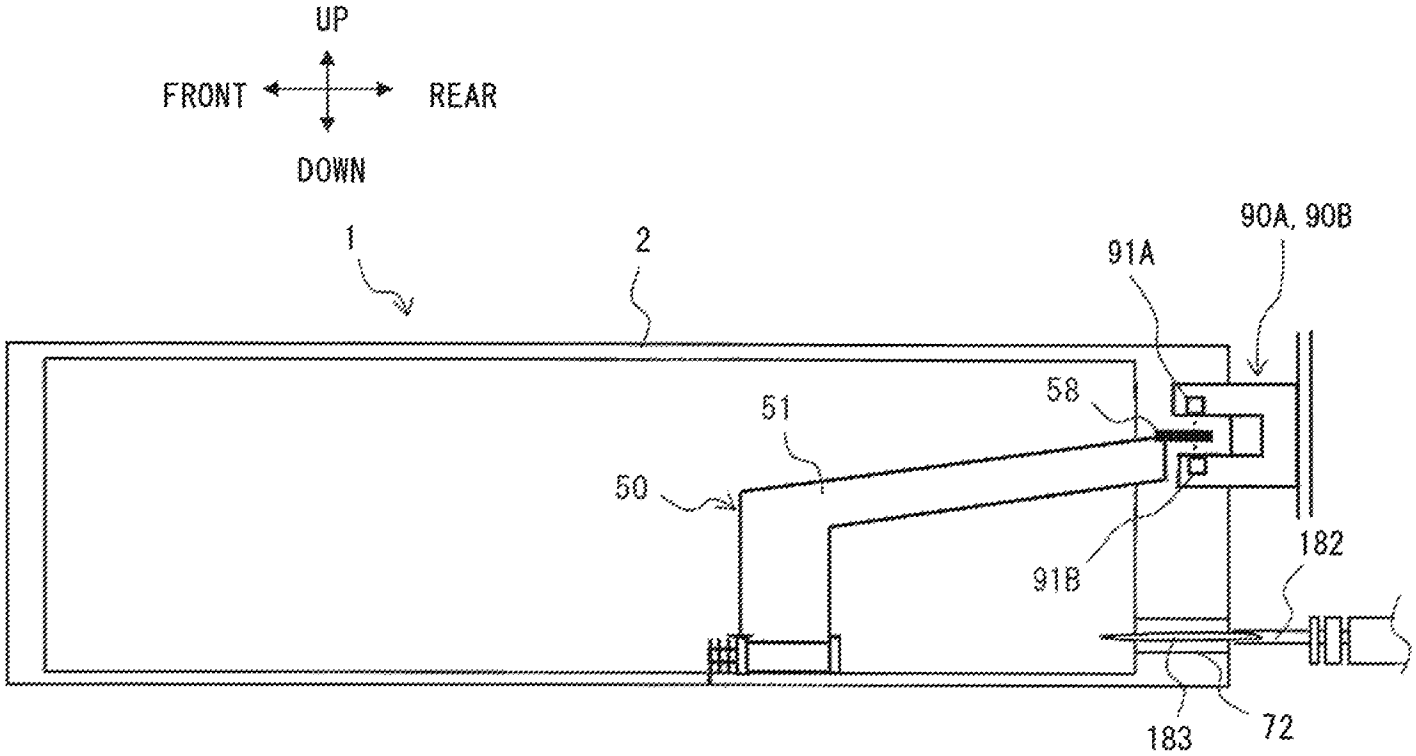
FIG. 17 is an explanatory diagram of optical sensors that are installed on a rear end side of the cartridge mourning portion of the printer.

The printer 100 has a structure that is configured to detect a displacement, in the generally horizontal direction, of the indicator portion 58. The detection of the displacement by the printer 100 will be explained with reference to FIG. 17 to FIG. 19. As shown in FIG. 17, first and second optical sensors 90A and 90B are arranged in the width direction of the housing 2, on the rear side of the cartridge mounting portion 108 (refer to FIG. 1) of the printer 100, in a position in the up-down direction that corresponds to the indicator portion 58. Each of the first sensor 90A and the second sensor 90B is a sensor that includes a light emitter 91A and a light receptor 91B, which sandwich the indicator portion 58 in the up-down direction.

Figure 18:
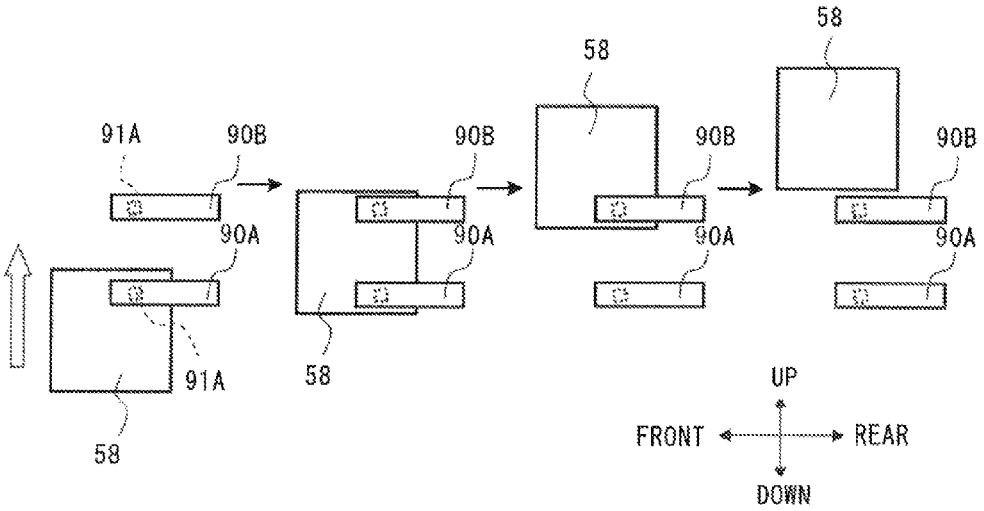
FIG. 18 is an explanatory diagram of a method for detecting an amount of ink, in which states of displacement of an indicator portion and positional relationships of a first sensor and a second sensor are shown from above in a simplified manner.
Figure 20:
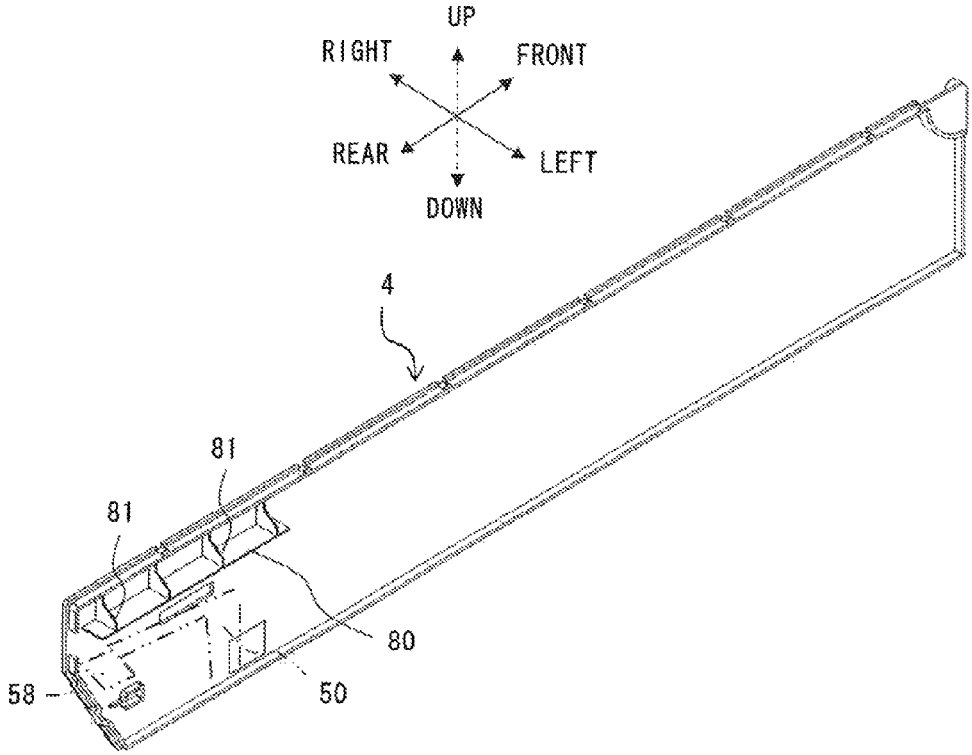
FIG. 20 is a perspective view of a lid of the housing as seen from the rear side.
Figure 21:
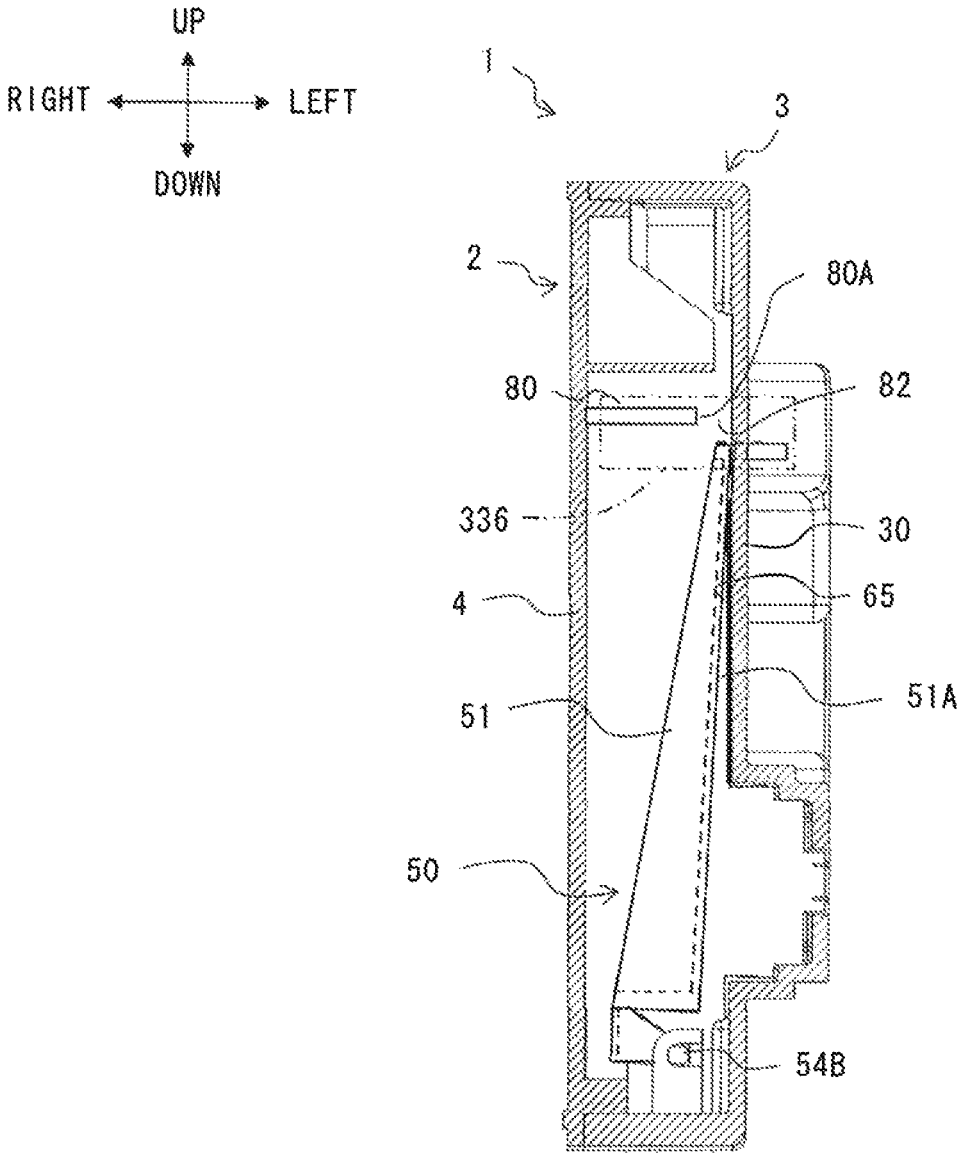
FIG. 21 is a cross sectional view as seen in the direction of arrows on a line XXI-XXI shown in FIG. 8, in a state in which the ink pack is removed.

As indicated by an upwardly directed white arrow shown in FIG. 18, the indicator portion 58 may be displaced in the width direction (the left-right direction) of the housing 2. When the indicator portion 58 blocks the light emitted from the light emitter 91A of the first sensor 90A toward the light receptor 91B (states that are first and second from the left in FIG. 18), the first sensor 90A is switched to an off state from an on state in which the light receptor 91B receives light. When the indicator portion 58 blocks the light emitted from the light emitter 91A of the second sensor 90B toward the light receptor 91B (states that are second and third from the left in FIG. 18), similarly, the second sensor 90B is switched to an off state. A detection signal that corresponds to the on state or of the of state of each of the first sensor 90A and the second sensor 90B is input to a CPU (not shown in the drawings) of the printer 100. In accordance with the detection signal from the first sensor 90A and the second sensor 90B, the CPU can determine in four levels the amount of ink inside the storage portion 71 of the ink pack 7.

More specifically, the CPU may determine the amount of ink in the following manner. When there is quite a large amount of ink inside the storage portion 71, the storage portion 71 has a sufficient thickness in the width direction (the left-right direction). Thus, the indicator portion 58 is in a position toward the right side. In this case, as shown in a leftmost state in FIG. 18, only the first sensor 90A, which is one of the first sensor 90A and the second sensor 90B that is positioned on the right side, is in the off state. As a result, the CPU may determine that the amount of ink in the storage portion 71 is "FULL," as shown in FIG. 19.

When the amount of ink inside the storage portion 71 decreases slightly from the above-described state, the indicator portion 58 moves slightly to the left side. In this case, both the first sensor 90A and the second sensor 90B are in the off state, as shown in the second state from the left in FIG. 18. As a result, the CPU may determine that although not full, the amount of ink in the storage portion 71 is "SUFFICIENT," as shown in FIG. 19.

After that, when the amount of ink inside the storage portion 71 further decreases, the indicator portion 58 moves further to the left side. In this case, the first sensor 90A is in the on state and the second sensor 90B is in the off state, as shown in the third state from the left in FIG. 18. As a result, the CPU may determine that the amount of ink in the storage portion 71 is "NEARLY EMPTY," as shown in FIG. 19.

After that, when the amount of ink inside the storage portion 71 further decreases and approaches an empty state, the indicator portion 58 moves even further to the left side. In this case, both the first sensor 90A and the second sensor 90B are in the on state, as shown in a rightmost state in FIG. 18. As a result, the CPU may determine that the amount of ink in the storage portion 71 is "EMPTY," as shown in FIG. 19.

Based on the above-described determination results, the CPU of the printer 100 may perform notification or prohibit printing etc. in accordance with the amount of ink.

Rib

Next, the rib 80 which is provided to inhibit the upper portion of the storage portion 71 from falling over, will be explained with reference to FIG. 20 to FIG. 24.

As shown in FIG. 20 to FIG. 24 the rib 80, which inhibits the storage portion 71 of the ink pack 7 from falling over, and the reinforcement ribs 81, which reinforce the rib 80, are provided on the upper inner surface of the rear portion of the lid 4. The rib 80 is provided extending generally in the horizontal direction, on the upper inner surface of the rear portion of the lid 4 and above the detection plate 50. A gap 82 exists between a left end 80A of the rib 80 and the left side surface of the housing 2, namely, between the left end 80A and the left wall 30 of the main body 3. The rib 80 is positioned further to the rear side than the rear end of the adhesion portion 65 of the left will 30 that is described above (refer also to FIG. 3 and FIG. 10). The rib 80 is arranged (refer to FIG. 21) further above a position, in the up-down direction, of the upper end of the adhesion portion 65. The reinforcement ribs 81 are extendingly provided generally in the vertical direction such that it intersects with the rib 80 in at least one location (at four locations in the present embodiment) with respect to the horizontal direction of the rib 80. The reinforcement ribs 81 couple the rib 80 and the surface on the right side of the housing 2, namely, the lid 4.

Figure 22:
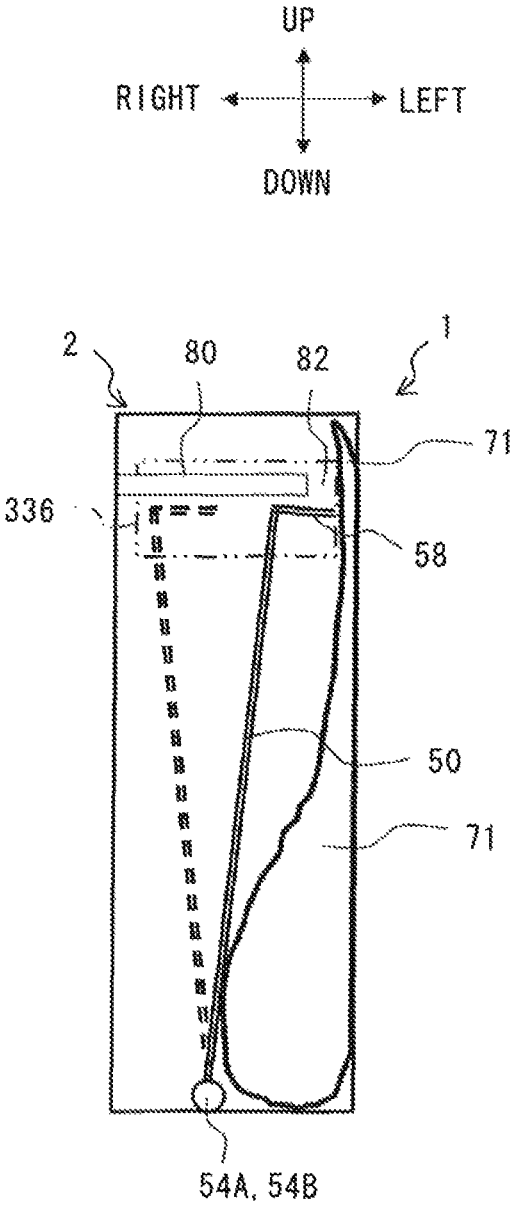
FIG. 22 is an explanatory diagram showing an effect of a rib.

The storage portion 71 of the ink pack 7 is in contact with and fixed to the adhesion portion 65 of the left wall 30. As shown in FIG. 22, an upper portion 71A of the storage portion 71 is inserted through the gap 82. When the amount of ink inside the storage portion 71 decreases due to the use of the ink and the fluid level drops, the inside of the upper portion 71A becomes empty, as shown in FIG. 22. If the rib 80 is not present, it is possible that the empty upper portion 71A may fall over or drop down toward the right side due to the elasticity of the bag forming the storage portion 71, from a state indicated by a solid line to a state indicated by a dotted line in FIG. 23. In this case, if this state continues, it is possible that the rotation position of the detection plate 50, which depends on the amount of ink, cannot accurately indicate the amount of ink due to the fallen upper portion 71A coming into contact etc. with the detection plate 50.

Figure 23:
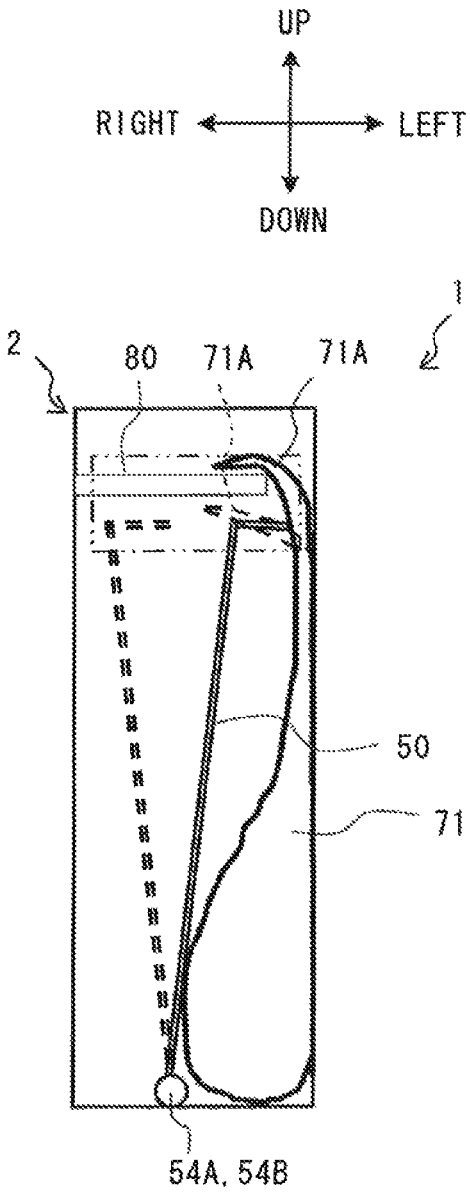
FIG. 23 is another explanatory diagram showing an elect of the rib.

In the present embodiment, in order to deal with the above-described situation, the rib 80 is provided and the upper portion 71A of the storage portion 71 is inserted through the gap 82 that is formed between the rib 80 and the left wall 30 of the main body 3. In this way, even if the upper portion 71A of the storage portion 71 tends to fall downward toward the right side, the rib 80 catches the upper portion 71A, as shown in FIG. 23, and can thus inhibit any further displacement of the storage portion 71 to the right side. Further, it is also possible to inhibit the upper side of the storage portion 71 from swelling and contacting with the detection plate 50 as shown by a dotted line in FIG. 24.

Figure 25:
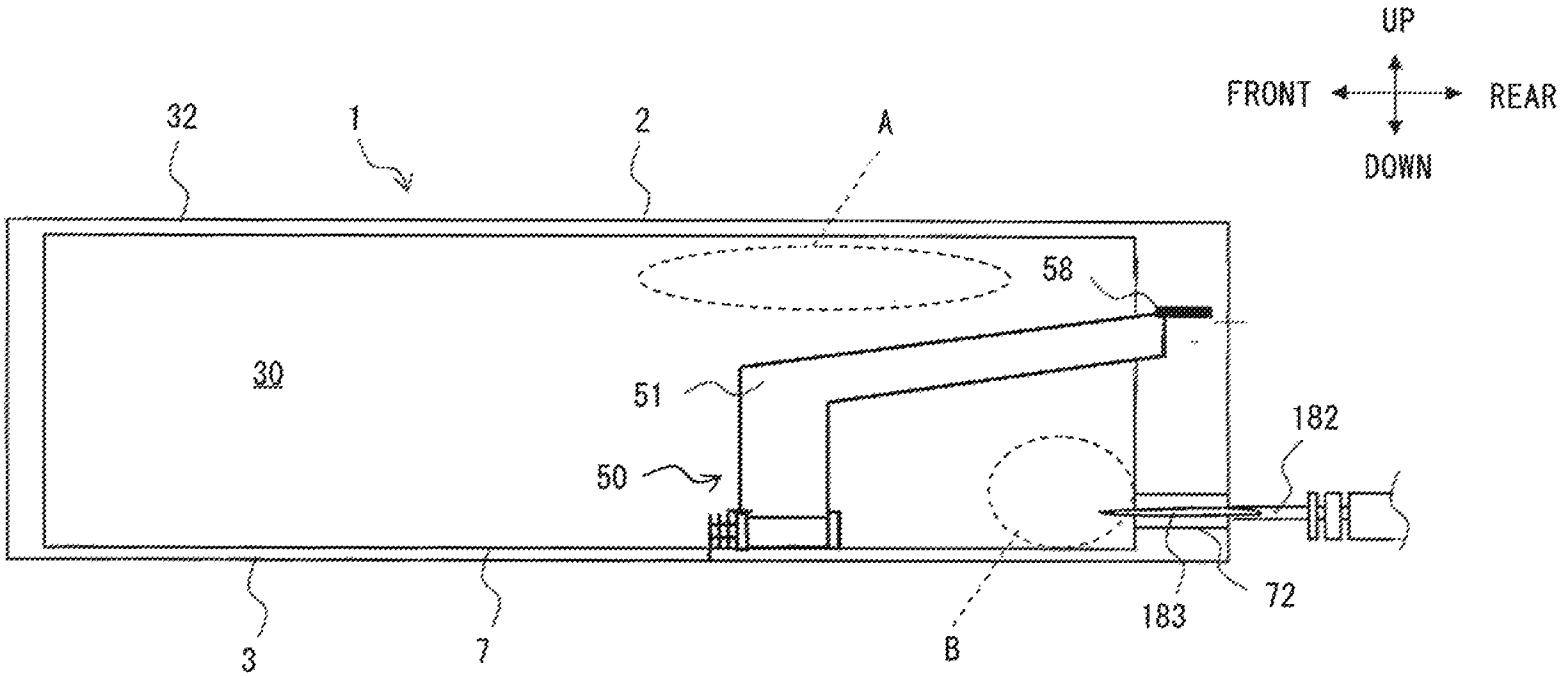
FIG. 25 is an explanatory diagram showing an inappropriate position for installation of the detection plate inside the housing.
Figure 26:
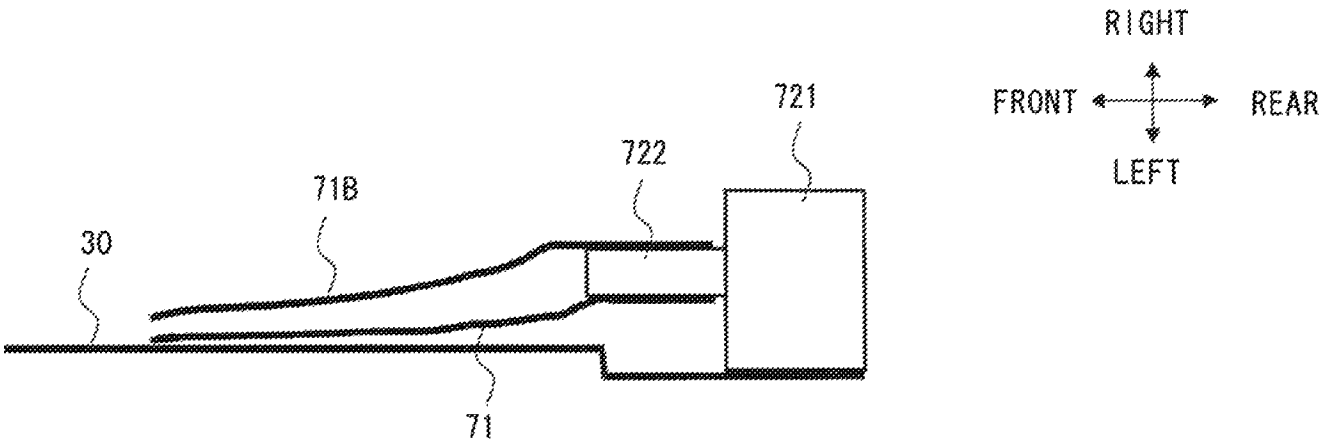
FIG. 26 is an outline view, as seen from a lower side, of a structure in the vicinity of a spout inside the housing.

Note that, as shown in FIG. 25, if the detection plate 50 is provided such that the contact plate portion 51 comes into contact with the storage portion 71 in an upper area A toward the rear of the housing 2 (a position in the vicinity of the top wall 32 toward the rear of the main body 3), the detection plate 50 cannot accurately detect the amount of ink in the storage portion 71. Further, if the detection plate 50 is provided such that the contact plate portion 51 comes into contact with the storage portion 71 in an area B that is close to the spout 72 of the ink pack 7, similarly, the detection plate 50 cannot accurately detect the remaining amount of ink, either. This is because, as shown in FIG. 26, a right side surface 71B of the storage portion 71 is in a fixed positional relationship regardless of the remaining amount of ink in the storage portion 71, due to the structure of the main body portion 721 that fixes the spout 72 to the housing 2 and the structure of the coupling portion 722 that is thermally welded to the sheets of the storage portion 71, and due, further, to positional relationships of these members with the storage portion 71. Thus, it is preferable to provide the detection plate 50 in a position in which the contact plate portion 51 does not contact with the storage portion 71 in the above-described area A and area B.

As described above, in the present embodiment, the support mechanism 60 of the detection plate 50 is provided on the housing 2 and has the two engagement portions 62 that are configured to rotatably support the detection plate 50. The engagement portions 62 are arranged in the axial direction X of the spout 72 (the front-rear direction of the housing 2) with the specific interval therebetween. The detection plate 50 has the two arm portions 52 and the shaft portions 54A and 54B. At least part of each of the arm portions 52 has elasticity and the arm portions 52 are provided with the specific interval therebetween. The shaft portions 54A and 54B protrude in the outward directions from the arm portions 52 respectively. The shaft portions 54A and 54B are arranged in the straight line with the interval therebetween, and have the shape that can be engaged with the engagement portions 62 of the support mechanism 60.

When at least one of the two arm portions 52 receives the external pressure in the inward direction that is opposite to the protrusion direction of the above-described shaft portions 54A and 54B, the detection plate 50 can be elastically deformed. Due to the elastic deformation, at least one of the shaft portions 54A and 54B provided on the at least one arm portion 52 can change its position to the extent that it does not engage with one of the engagement portions 62. When the external pressure is no longer applied, the elastic force to approach the above-described specific interval occurs in the arm portions 52. The two engagement portions 62 thus engage with the shaft portions 54A and 54B, respectively. The shaft portions 54A and 54B are in positions that include the rotation center of each of the arm portions 52. Depending on the amount of ink inside the storage portion 71, the detection plate 50 rotates around the shaft portions 54A and 54B that are on an axial line that is parallel to the axial direction X of the spout 72. The user or the printer 100 can detect changes in the amount of ink, due to the rotation of the detection plate 50.

When the ink cartridge 1 is assembled, the above-described detection plate 50 is mounted on the support mechanism 60 that is fixed to the housing 2. As described above, at least part of each of the arm portions 52 has elasticity. Thus, it is possible to reduce a distance between the two arm portions 52 by applying external pressure. When mounting the detection plate 50 on the support mechanism 60, the operator applies the external pressure, using his or her hand, to at least one of the two arm portions 52 in the inward direction, which is opposite to the protrusion direction of the corresponding at least one shaft portion 54A or 54B. At least one of the arm portions 52 is thus caused to deform elastically up to an extent in which at least one of the shaft portions 54A and 54B and at least one of the engagement portions 62 do not engage with each other. In this state, the operator causes the shaft portion 54A or the shaft portion 54B of one of the arm portions 52 to engage with one of the engagement portions 62. The operator arranges the shaft portion 54A or the shaft portion 54B of the other arm portion 52 in a position corresponding, to the other engagement portion 62 and loosens his or her hand to release the external pressure being applied to the at least one arm portion 52. The arm portions 52 return, by elastic force, to their original shape. As a result, the above-described two shaft portions 54A and 54B respectively engage with the above-described engagement portions 62. The detection plate 50 is thus rotatably supported around the axial line that is parallel to the axial direction X of the spout 72.

As described above, by using the elastic force of the two arm portions 52 of the detection plate 50, the operator can easily mount the detection plate 50 on the support mechanism 60. As a result, the ease of assembly of the detection plate 50 can be improved, and the productivity of the ink cartridge 1 can be improved.

In the present embodiment, the detection plate 50 includes the contact plate portion 51, the left side of which comes into contact with the storage portion 71. As the storage portion 71 comes into contact with the left surface 51A of the contact plate portion 51, the greater the amount of ink inside the storage portion 71, the more the storage portion 71 bulges and pushes the contact plate portion 51 to the right. The detection plate 50 rotates due to this pressure and thus it is possible to achieve rotation of the detection plate 50 depending on the amount of ink.

Further, the detection plate 50 is configured such that the right side end portion of the arm portion 52 extends further to the right than the right side end portion of the contact plate portion 51. This is due to the following reasons. From the point of view of maintaining strength at the time of elastic deformation, a structure is conceivable in which at least part of the arm portion 52 extends beyond the contact plate portion 51. In this case, if a structure is adopted in which the left side of the arm portion 52 extends beyond the contact plate portion 51, it is possible that the storage portion 71, which bulges depending on the amount of ink as described above, may come into contact with the above-described extending arm portion 52 and not the contact plate portion 51 (or may come into contact with the arm portion 52 as well as the contact plate portion 51). In order to avoid this adverse effect, in the present embodiment, the right side end portion of the arm portion 52 extends even further to the right than the right side end portion of the contact plate portion 51. With this structure, it is possible to inhibit the left side end portion of the arm portion 52 from extending further to the left side than the contact plate portion 51, and the above-described adverse effect can be avoided. As a result, it is possible to achieve the rotation of the detection plate 50 that favorably follows the changes in the amount of ink.

Figure 30:
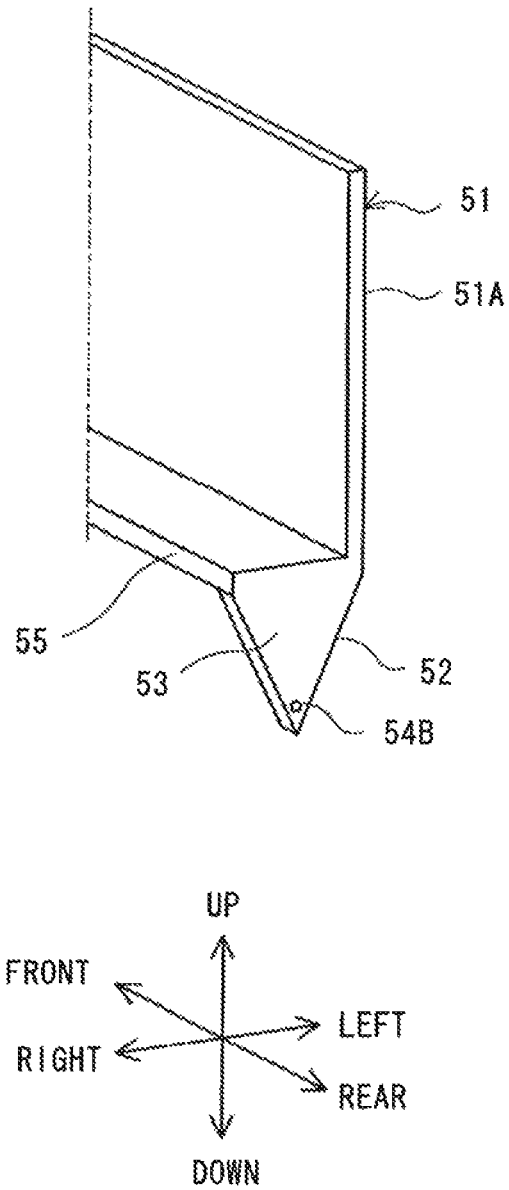
FIG. 30 is a schematic explanatory diagram of a modified example relating to an extended structure of a right end portion of an arm portion.
Figure 31:
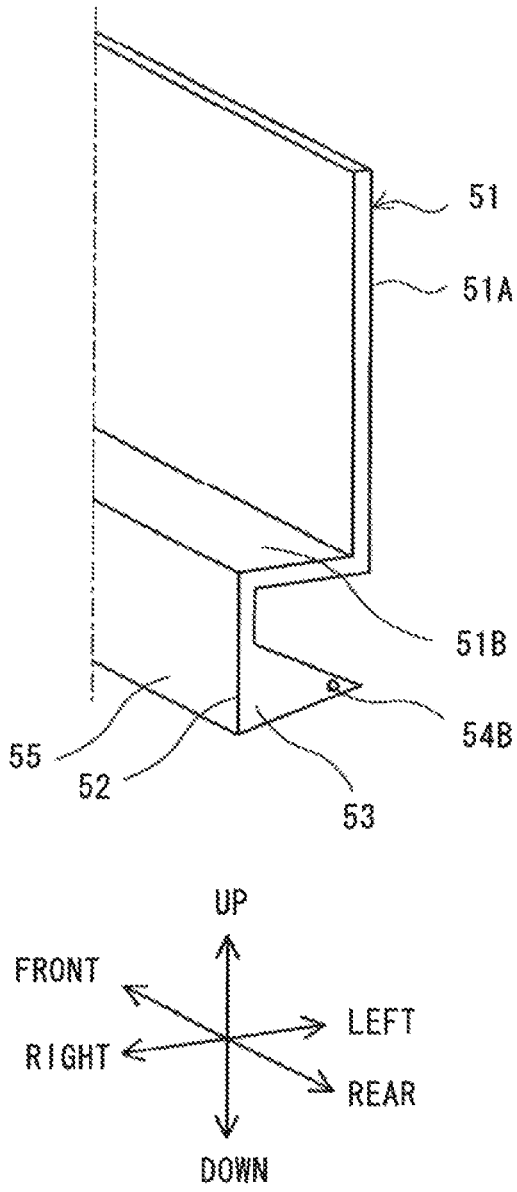
FIG. 31 is a schematic explanatory diagram of another modified example relating to the extended structure of the right end portion of the arm portion.

In a modified example shown in FIG. 30, the connecting plate portion 55 is provided extending horizontally to the right from the lower end of the contact plate portion 51 such that the connecting plate portion 55 is further to the right than the contact plate portion 51, and the arm portions 52 extend downward from the connecting plate portion 55. In this case also, as the arm portions 52 are provided further to the right than the contact plate portion 51, the above-described effects can be obtained. In another modified example shown in FIG. 31, a horizontal plate portion 51P is provided, which extends horizontally to the right from the lower end of the contact plate portion 51, and the connecting plate portion 55 extends downward from the right end of the horizontal plate portion 51P. In this case also, the connecting plate portion 55 is provided further to the right than the contact plate portion 51, and the arm portions 52 are also provided further to the right than the contact plate portion 51. Thus, the above-described effects can be obtained.

In the present embodiment the arm portions 52 include the support plate portions 53. The support plate portions 53 are formed in a generally triangular or generally trapezoidal shape expanding from the left end areas, in which are provided the shaft portions 54A and 54B, respectively, toward the right side areas. As a result of this, the operator can easily cause elastic deformation of the left end area of the support plate portion 53 that is the side having a narrower width, and can thus easily reduce the distance between the above-described two shaft portions 54A and 54B.

In the present embodiment, the detection plate 50 includes the connecting plate portion 55 that connects the support plate portions 53 of the two arm portions 52 in the area on the right side. In this way, the support plate portions 53 that deform elastically can be supported firmly by the connecting plate portion 55 in the end area.

In the present embodiment, of the shaft portions 54A and 54B, the protrusion length of the one shaft portion 54A is longer than the protrusion length of the other shaft portion 54B. Thus, when causing the shaft portions 54A and 54B to engage with the two engagement portions 62 of the support mechanism 60, the operator can insert the longer shaft portion 54A into one of the engagement portions 62 first, then cause the arm portion 52 with the shorter shaft portion 54B to elastically deform, and then cause the shaft portion 54B to engage with the other engagement portion 62. As a result, the operator can reliably cause the elastic deformation of the detection plate 50 with a small amount of deformation, and can easily mount the detection plate 50 on the support mechanism 60.

In the above-described embodiment, the support mechanism 60 has the two mounting plate portions 61 that are arranged such that they are orthogonal to the axial direction X of the spout 72 and have the specific interval therebetween in the axial direction X. The engagement portions 62 are formed as the through holes that penetrate through the mounting plate portions 61 in the axial direction X, or as the recessed portions that open in the directions facing the shaft portions 54A and 54B, respectively. In this way, the housing 2 with the support mechanism 60 can be thrilled without using a slide on a forming die. Therefore, it is possible to easily manufacture the housing 2 in which the detection plate 50 can easily be attached to the support mechanism 60.

In the present embodiment, the indicator portion 58 of the detection plate 50 is a flat plate that protrudes from the end on the opposite side to the above-described arm portions 52 into the first opening 336 on the rear of the housing 2. Inside the first opening 336, the indicator portion 58 extends in the axial direction X of the spout 72 and in the direction toward the storage portion 71 from the contact plate portion 51 of the detection plate 50. Thus, the indicator portion 58 can indicate the amount of ink in a sensory manner that is easy for the user to understand.

Figure 27:
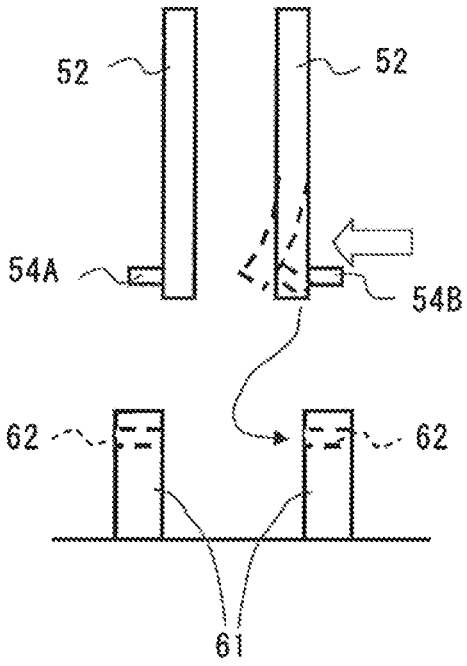
FIG. 27 is an explanatory diagram of a method for attaching shaft portions of the detection plate to a support mechanism.
Figure 28:
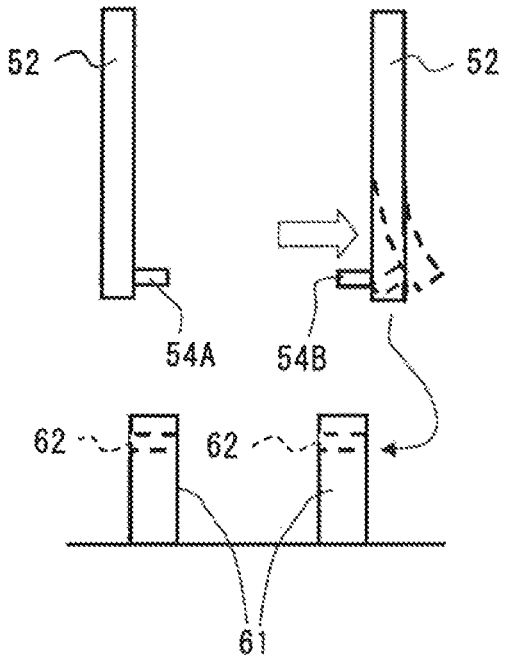
FIG. 28 is an explanatory diagram of a method for attaching the shaft portions according to a modified example.

In the above-described embodiment, the shaft portions 54A and 54B protrude in the outward directions that intersect with the extension direction of the arm portions 52, as schematically shown in FIG. 27. However, as shown in FIG. 28, the shaft portions 54A and 54B may protrude in the inward directions that intersect with the extension direction of the arm portions 52. In this case, the operator may apply external pressure to at least one of the arm portions 52 in the outward direction that is opposite to the protrusion direction of the corresponding at least one shaft portion 54A or 54B, and may cause the shaft portions 54A and 54B to engage with the engagement portions 62 of the mounting plate portions 61. Deformation of the arm portion 52 shown on the right side in FIG. 28 is indicated by a dotted line, when the external pressure is applied to the arm portion 52 in the opposite direction (to the right in FIG. 28) to the direction of protrusion of the shaft portion 54B.

Figure 29:
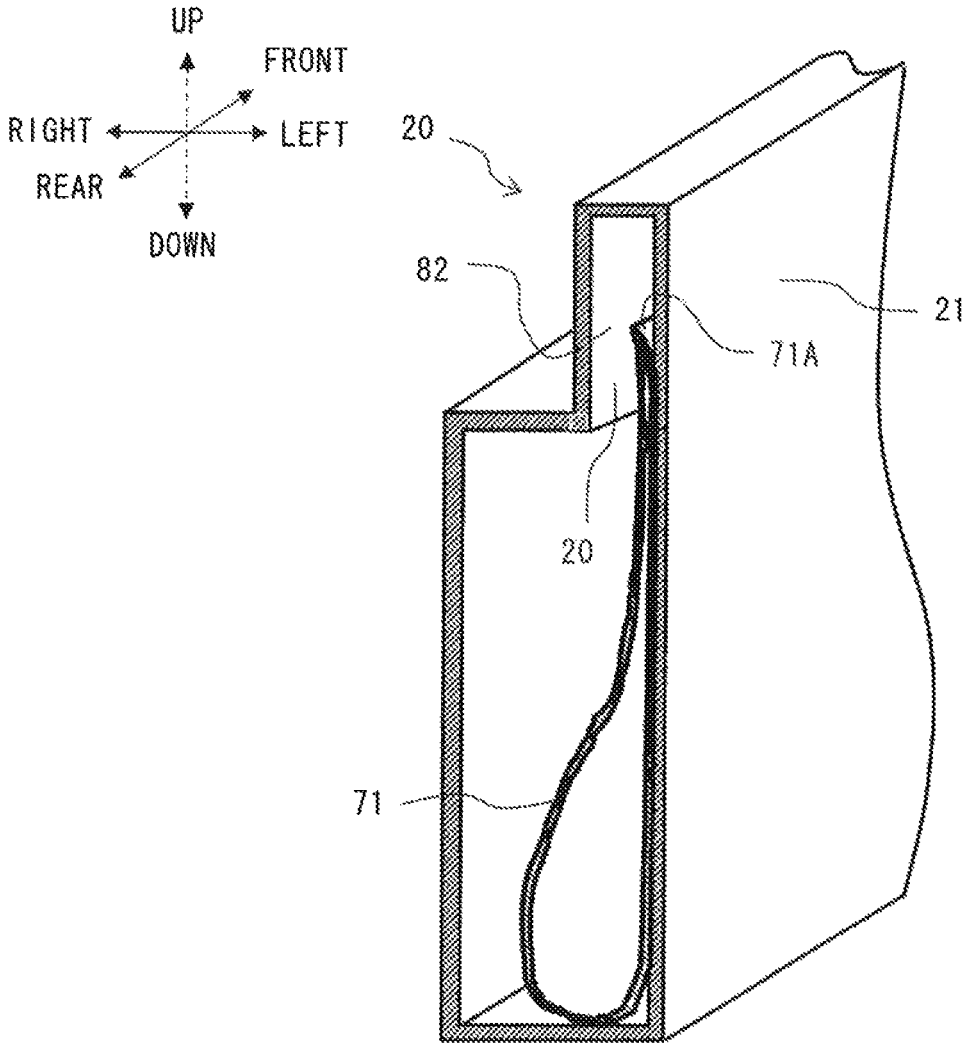
FIG. 29 is an exploded perspective view show mg part of a housing according to a modified example that has a cut out portion that is cut out in an L shape.

In the above-described embodiment, the rib 80 that inhibits displacement of the ink pack 7 is provided inside the housing 2, but a structure to inhibit the displacement of the ink pack 7 is not limited to the rib 80. For example, as shown in FIG. 29, it housing 20 may be formed as a generally rectangular parallelepiped having a longitudinal direction, a lateral direction and a thickness direction, in which at least the upper portion on the rear side is cut out in an L shape. In this case, the housing 20 has, at least above an arrangement area for the detection plate 50, a side surface 21 that has the same direction as the above-described lateral direction and that forms the specific gap 82 with the left wall 30 of the housing 20. The side surface 21 functions as a portion that inhibits the displacement of the ink pack 7.

An ink cartridge 1000 according to another embodiment will be explained with reference to FIG. 32 to FIG. 35. In addition to the various structural members of the ink cartridge 1 (refer to FIG. 2), the ink cartridge 1000 has a film 1010 that is arranged between the ink pack 7 and the detection plate 50. Hereinafter, structural members that are the same as those of the ink cartridge 1 will be assigned the same reference numerals and an explanation thereof will be omitted.

Figure 32:
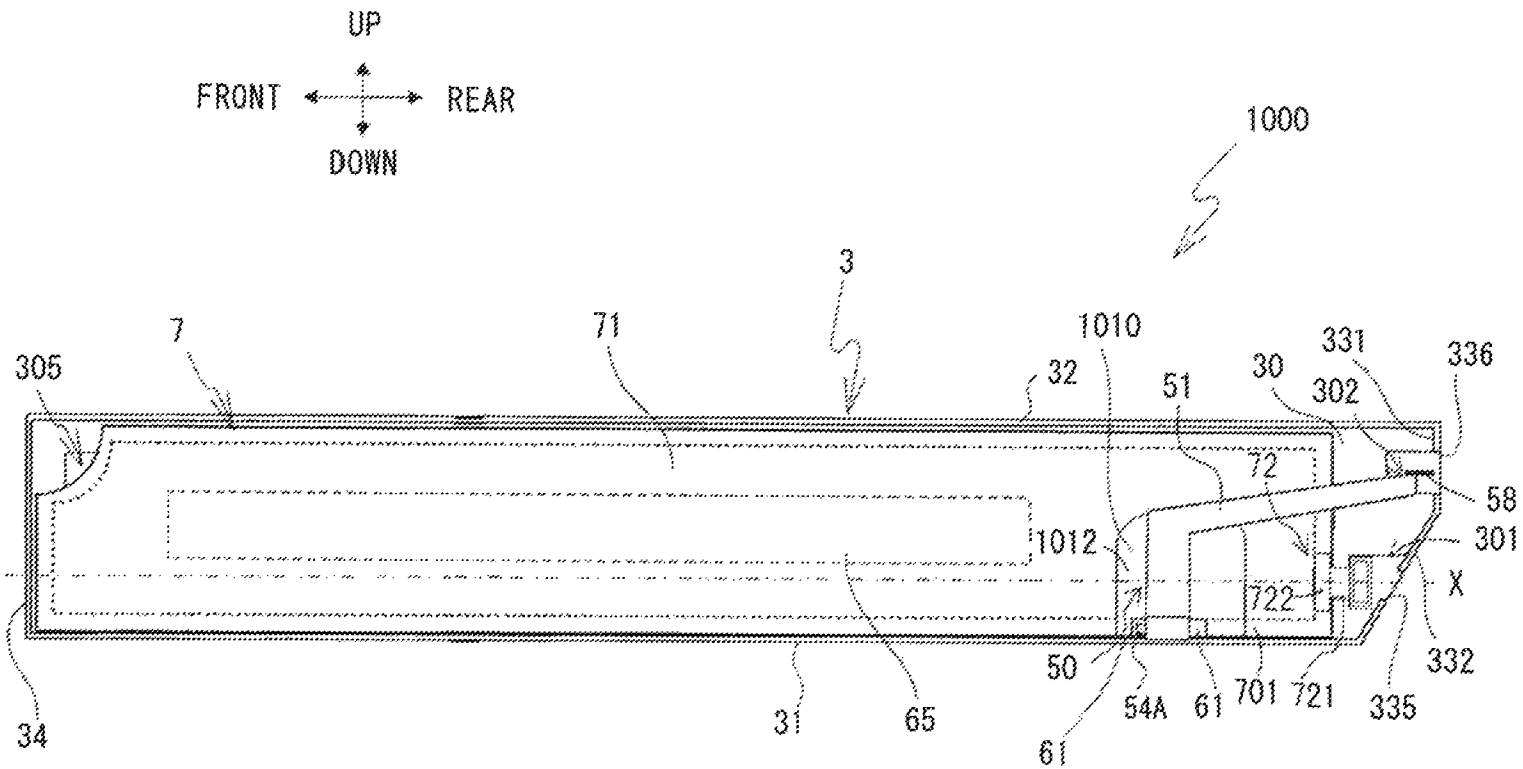
FIG. 32 is a side view of a main body of a housing in which the ink pack and the detection plate are installed.
Figure 33:
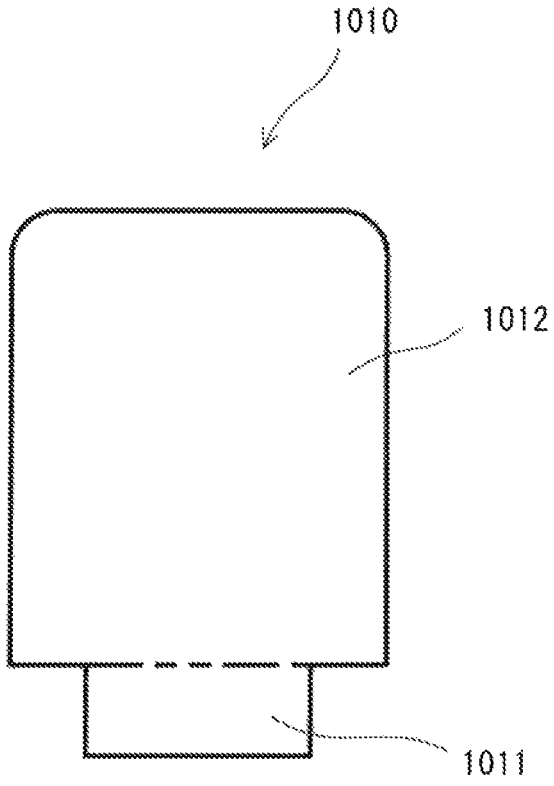
FIG. 33 is an outline plan view of a film.

As shown in FIG. 32 and FIG. 33, the film 1010 is a single sheet of film having a generally rectangular shape overall, whose longitudinal direction is the up-down direction. The film 1010 includes a main body portion 1012 and an end portion 1011. The film 1010 is formed of a film having less rigidity than the ink pack 7, such that the film 1010 does not interfere with the deformation of the ink pack 7 due to the changes in the amount of ink. The end portion 1011 of the film 1010 is affixed with an adhesive or the like, to the bottom wall 31 between the mounting plate portions 61 provided on the main body 3. Thus, the width (the length in the direction orthogonal to the longitudinal direction of the film 1010) of the end portion 1011 is smaller than the interval between the mounting plate portions 61.

The width of the main body portion 1012 is at least larger than the interval between the mounting plate portions 61 and is a sufficient length that can cover the mounting plate portions 61. Further, in the longitudinal direction (the up-down direction) of the film 1010, the main body portion 1012 is formed such that it extends from the bottom wall 31 past the lower end of the adhesion portion 65, and as far as the bent portion of the contact plate portion 51 of the detection plate 50.

The end portion 1011 of the film 1010 is bent and is affixed between the mounting plate portions 61 of the main body 3 such that the bent portion is positioned on the side of the left wall 30. The main body portion 1012 that extends upward from the fixed end portion 1011 is arranged between the detection plate 50 and the ink pack 7 and also between the mounting plate portions 61 and the ink pack 7. The film 1010 is arranged over the mounting plate portions 61 and the detection plate 50.

When the ink cartridge 1000 is subject to an external impact, such as when the ink cartridge 1000 is dropped or the like, the ink inside the ink pack 7 may suddenly moves due to the impact. More specifically, for example, when the ink cartridge 1000 is dropped and the bottom wall 31 hits a floor surface, the ink cartridge 1000 receives an impact from the floor surface. The ink inside the ink pack 7 of the main body 3 moves suddenly in the upward direction due to the force of the impact from the floor surface. Additionally, when the ink cartridge 1000 is dropped, the ink cartridge 1000 may hit the floor surface in a state in which the bottom wall 31 is inclined, or, even if the ink cartridge 1000 drops straight down, as the bottom wall 31 is thin, there is poor stability and the ink cartridge 1000 may become inclined. Thus, not only the impact in the upward direction, but also the impact in the diagonally upward direction or so on may be applied to the ink cartridge 1000, and a force in the horizontal direction may act on the ink in the ink pack 7.

The central portion of the ink pack 7 is fixed to the main body 3 by the adhesion portion 65. However, the peripheral portion around the central portion is not fixed and thus, the peripheral portion of the ink pack 7 can deform depending on the amount of ink. As described, above, the ink pack 7 is formed by overlapping the two rectangular flexible sheets made of transparent plastic, and by thermally welding, the four peripheral sides. Thus, the peripheral portion of the ink pack 7 is like a thin sheet. Meanwhile, the mounting plate portions 61 that support the detection plate 50 are formed such that they protrude only by a minimum necessary height from the bottom wall 31, due to the ease of detection by the detection plate 50 and due to installation space and cost considerations. This type of the ink pack 7 and the detection plate 50 are arranged in the limited space inside the ink cartridge 1000.

Figure 34:
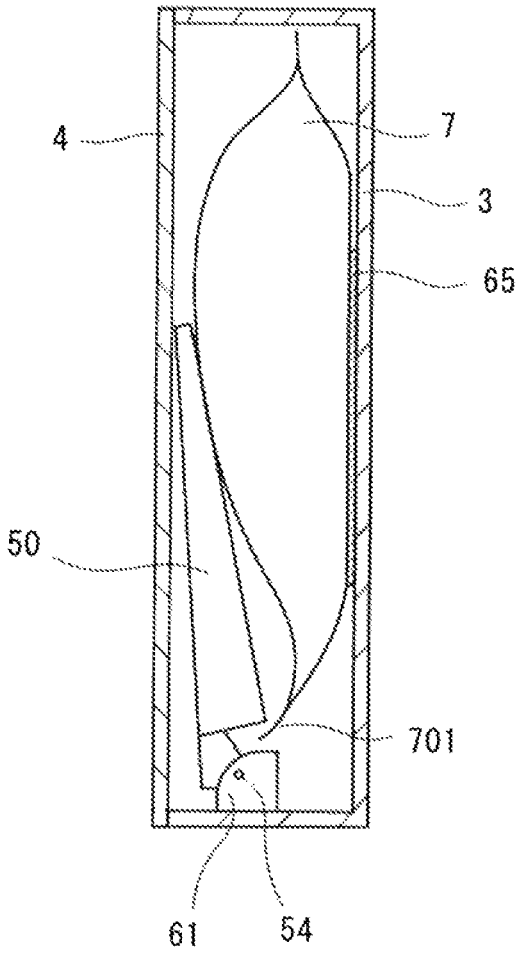
FIG. 34 is an explanatory diagram showing a state when an ink cartridge receives an impact from the outside, when a film is not arranged between a detection plate and an ink pack.

As shown in FIG. 34, in a known ink cartridge 1100, when the impact from the floor results in a diagonally upward force with respect to the ink inside the ink pack 7, t a lower end portion 701 of the ink pack 7 may be pulled by sudden movement of the ink in a diagonally upward direction and bend upward. If this happens, the lower end portion 701 of the ink pack 7 may enter into the engagement locations where the mounting plate portions 61 and the shaft portions 54A and 54B are engaged with each other. In this type of case, the lower end portion 701 of the ink pack 7 may become an obstacle to the movement of the detection plate 50, and thus the printer 100 may become unable to accurately detect the amount of ink remaining.

For that reason, in the present embodiment, the film 1010 is arranged between the ink pack 7 and the detection plate 50.

Figure 24:
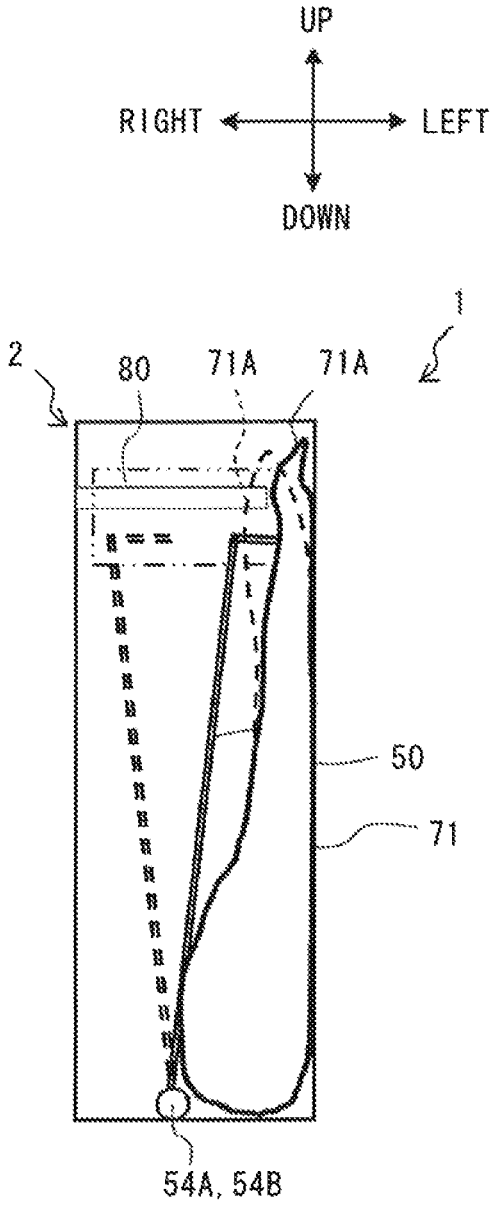
FIG. 24 is yet another explanatory diagram showing an effect of the rib.

When the ink inside the ink pack 7 is full, the ink is accumulated in the lower part of the ink pack 7, and the lower part of the ink pack 7 is in a bulging state, as shown in FIG. 24, for example. Although not shown in the drawings, at that time, the film 1010 is clamped between the detection plate 50 and the ink pack 7. Although the bulge becomes smaller when the amount of ink inside the ink pack 7 decreases, the film 1010 continues to be clamped between the detection plate 50 and the ink pack 7.

Figure 35:
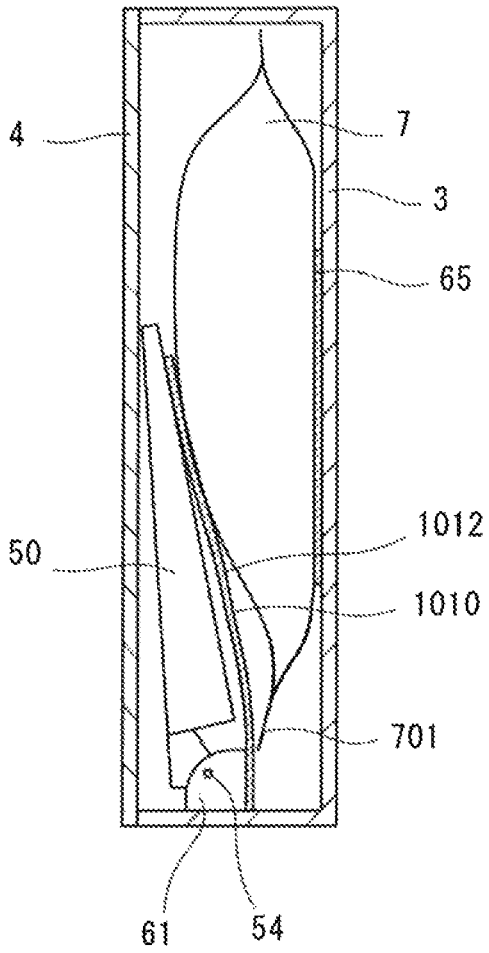
FIG. 35 is an explanatory diagram showing a state when the ink cartridge receives an impact from the outside, when the film is arranged between the detection plate and the ink pack.

Even if the ink cartridge 1000 is dropped, as described above, and the inside of the ink pack 7 moves suddenly upward or diagonally upward and the lower end portion 701 of the ink pack 7 is pulled diagonally upward, the film 1010 that is arranged between the ink pack 7 and the detection plate 50 inhibits the diagonally upward movement of the lower end portion 701 of the ink pack 7. The film 1010 can inhibit the lower end portion 701 of the ink, pack 7 from becoming trapped between the engagement locations of the mounting plate portions 61 with the shaft portions 54A and 54B. Further, even if the film 1010 is pushed by the lower end portion 701 of the ink pack 7 in the direction of the engagement portions of the mounting plate portions 61 with the shaft portions 54, as shown in FIG. 35, it is difficult for the film 1010 to become trapped between the engagement locations of the mounting plate portions 61 and the shaft portions 54A and 54B. This is because of friction occurring between the detection plate 50 and the main body portion 1012 of the film 1010, which is clamped between the ink pack 7 and the detection plate 50. It should be noted that the whole of the main body portion 1012 of the film 1010 need not necessarily be clamped between the detection plate 50 and the ink pack 7, and it is sufficient if at least part of the main body portion 1012 may be clamped between the detection plate 50 and the ink pack 7.

By the sudden movement of the ink inside the ink pack 7, a force from the ink pack 7 is applied to the detection plate 50, but the movement of the detection plate 50 can be regulated by coming into contact with the lid 40. Thus, a force is also applied from the detection plate 50 in the direction toward the ink pack 7. At this time, because the film 1010 receives the forces from both directions between the ink pack 7 and the detection plate 50, the film 1010 can be reliably clamped. Further, the film 1010 has a restoring force. For that reason, even if the film 1010 is pushed toward the engagement locations of the mounting plate portions 61 and the shaft portions 54A and 54B by the lower end portion 701 of the ink pack 7, it is difficult for the film 1010 to become trapped between the engagement locations of the mounting plate portions 61 and the shall portions 54A and 54B.

The respective coefficients of friction of the ink pack 7, the detection plate 50 and the film 1010 are not particularly limited. As the coefficient of friction becomes larger, an area of the main body portion 1012 of the film 1010 that is clamped between the detection plate 50 and the ink pack 7 may be smaller. Note that, it is preferable for corners of the main body portion 1012 to be formed in an arc shape, such that the ink pack 7 does not get caught on the corners when the ink cartridge 1000 is dropped and the ink inside the ink pack 7 moves and the ink pack 7 deforms.

In the above-described embodiment, the film 1010 is formed separately from the sheets of the ink pack 7, but the film 1010 may be formed integrally with the sheets forming the ink pack 7. Specifically, a portion having an outer shape such as the main body portion 1012 of the film 1010 may be provided on one of the sheets forming the ink pack 7. In this case, this portion may be bent and arranged between the detection plate 50 and the ink pack 7. The shape of the film 1010 is not limited to the rectangular shape and may be another shape, such as a circular shape. The film 1010 may be formed of plastic having any type of thickness. The material of the film 1010 may be a material other than plastic and may be paper, cloth or the like. In this case, the size, shape and thickness etc. of the film 1010 may be changed as appropriate such that the film 1010 does not obstruct the deformation of the ink pack 7 due to the changes in the amount of ink.

Next, with reference to FIG. 36, an ink cartridge 2000 of another embodiment will be explained. In addition to the various structural members of the above-described ink cartridge 1 (refer to FIG. 2), the ink cartridge 2000 has rod-shaped members 2010 on the bottom wall 31 in the vicinity of the mounting plate portions 61. Hereinafter, structural members that are the same as those of the ink cartridge 1 will be assigned the same reference numerals and an explanation thereof will be omitted.

Figure 36:
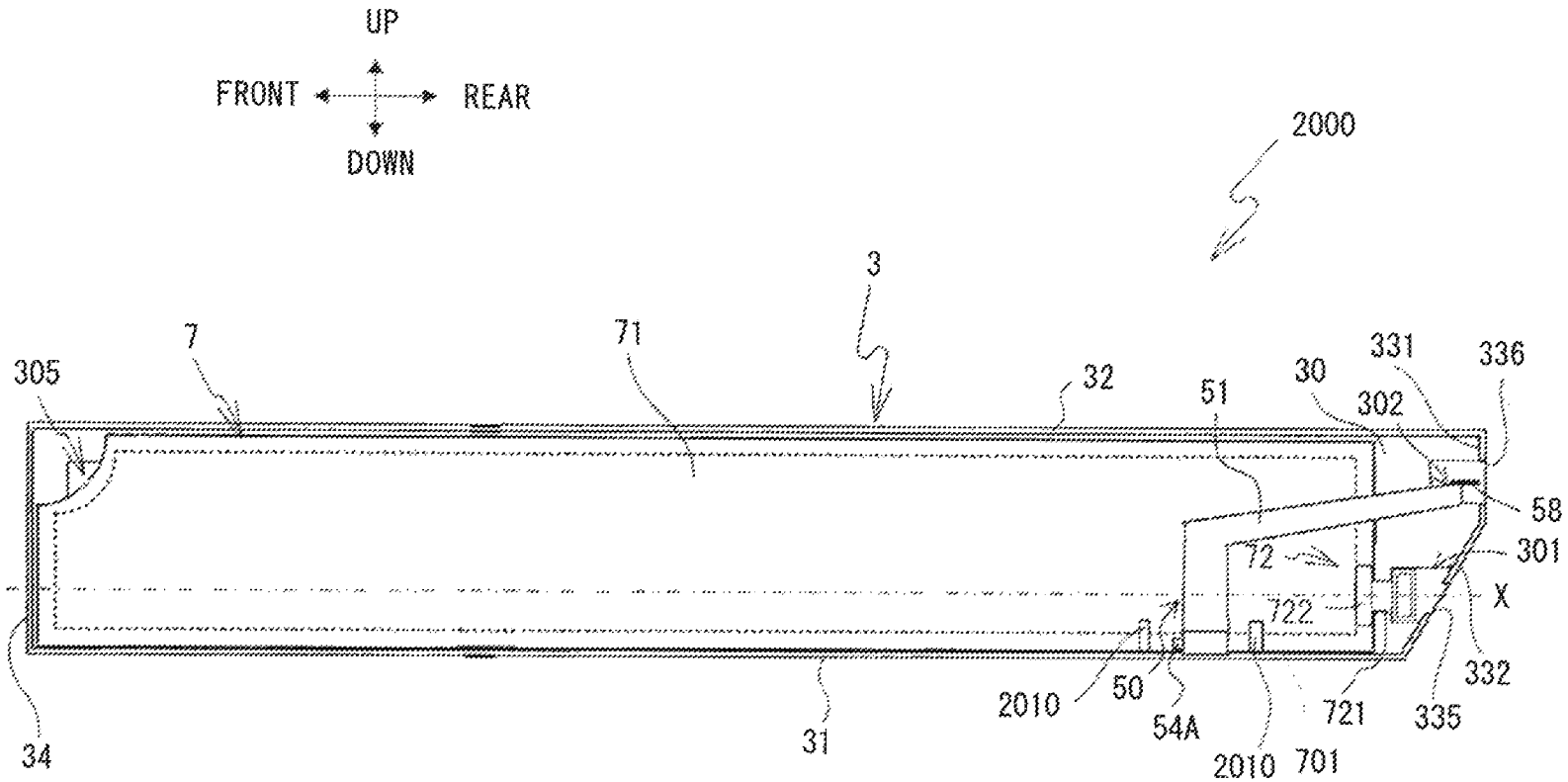
FIG. 36 is a side view of a main body of a housing in which the ink pack and the detection plate are installed.

As shown in FIG. 36, the rod-shaped members 2010 are provided extending from the bottom wall 31 toward the top wall 32 to a position slightly beyond the location at which the periphery of the ink pack 7 is thermally welded. The rod-shaped members 2010 are formed integrally with the main body 3. At least part of the rod-shaped members 2010 is disposed in a position that is between the ink pack 7 and the engagement locations of the mounting plate portions 61 and the shaft portions 54A and 54B (hereinafter referred to as engagement portions), in the direction in which the ink pack 7 and the detection plate 50 face each other (namely, in the left-right direction of the ink cartridge 2000). Note that the direction in which the ink pack 7 and the detection plate 50 face each other is the direction that is orthogonal to the inner surface of the left wall 30 to which the ink pack 7 is affixed. Further, the rod-shaped members 2010 are disposed in two locations sandwiching the mounting plate portions 61 in the vicinity of the mounting plate portions 61. The rod-like members 2010 are separated by a specific interval in the front-rear direction from the mounting plate portions 61, such that the rod-shaped members 2010 do not obstruct the movement of the detection plate 50. The rod-shaped members 2010 may be shaped like a circular column, or like a square column.

When an external impact is applied to this type of the ink cartridge 2000 by being dropped or the like, as described above, the ink, moves suddenly inside the ink pack 7 due to the impact.

Specifically, the ink moves suddenly inside the ink pack 7 in the upward or diagonally upward direction. Due to the sudden movement of the ink, the lower end portion 701 of the ink pack 7 may be pulled diagonally upward. In the present embodiment, the rod-shaped members 2010 that are disposed between the ink pack 7 and the engagement portions in the left-right direction can regulate the diagonally upward movement of the lower end portion 701 of the ink pack 7. The rod-shaped members 2010 can inhibit the lower end portion 701 of the ink pack 7 from becoming trapped in the engagement portions. In the present embodiment, the rod-shaped members 2010 are disposed in the two locations sandwiching the mounting plate portions 61, and thus, it is possible to reliably inhibit the lower end portion 701 of the ink pack 7 from becoming trapped in the engagement portions.

As long as there is no obstruction to the deformation of the ink pack 7, such as expansion and contraction due to the changes in the amount of ink, and to the movement of the detection plate 50 due to the deformation of the ink pack 7, a member having another shape may be similarly arranged in place of the rod-shaped members 2010. For example, a flat plate shaped member may be adopted such that a flat surface thereof is arranged parallel to or orthogonal to the front wall 34. A member may be adopted whose main body extends in another chosen direction between the main body 3 and the lid 4. Further, the material of the member is not particularly limited, and as long as it is able to inhibit the lower end portion 701 of the ink pack 7 from deforming and moving to the engagement portions, the member may be formed from film, resin foam, sponge, a wood chip or the like. In this case, it is preferable for the film to have a higher rigidity than the film of the above-described embodiment, and it is preferable for the film to have a rigidity at which the film is not deformed when pushed by the lower end portion 701 of the ink pack 7 when the ink cartridge 2000 receives an external impact.

The rod-shaped member 2010 may be formed as a separate member from the main body 3, and may be fixed to the bottom wall 31 of the main body 3. The one rod-shaped member 2010 only may be disposed adjacent to the mounting plate portion 61 on one side. Even in this case, it is possible to inhibit the lower end portion 701 of the ink pack 7 from bending up due to the impact of being dropped and becoming trapped in the engagement portions. Three or more of the rod-shaped members 2010 may be provided.

Figure 37:
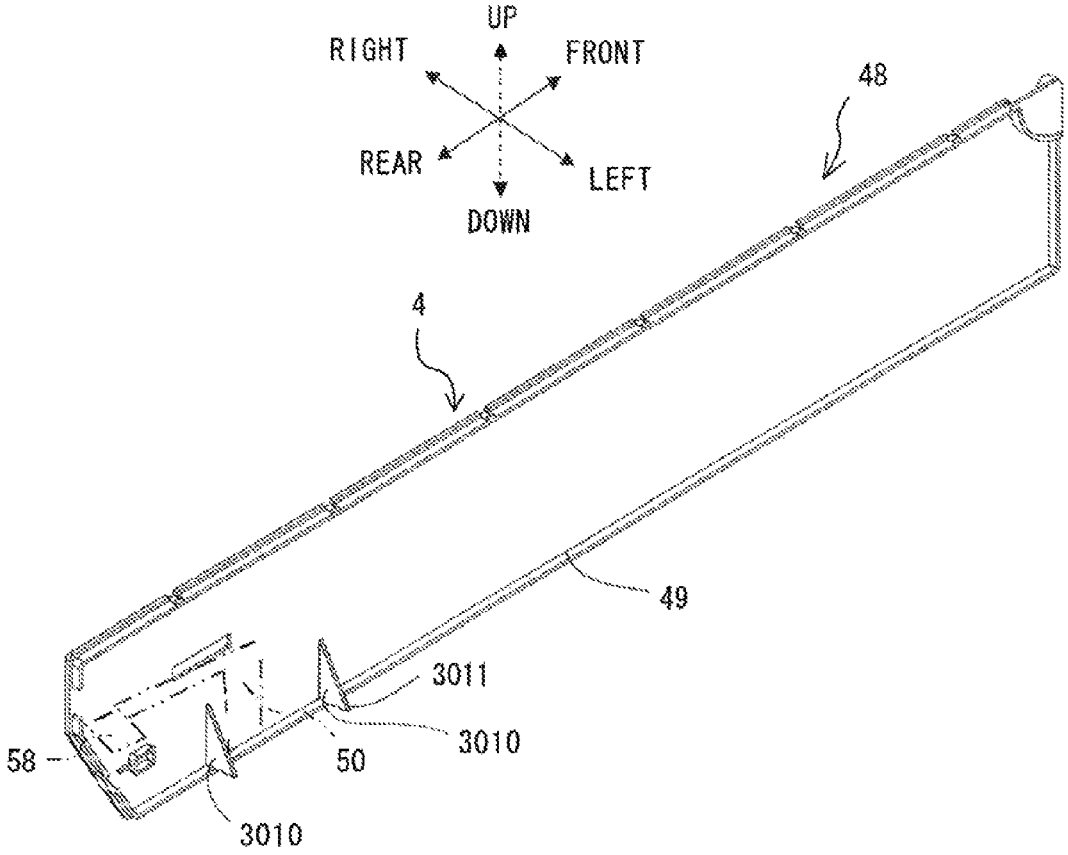
FIG. 37 is a perspective view of a lid of a housing as seen from a rear side.

An ink cartridge 3000 of yet another embodiment will be explained with reference to FIG. 37. In addition to the various structural members of the above-described ink cartridge 1 (refer to FIG. 2), the ink cartridge 3000 has plate members 3010 provided on the lid 4. Hereinafter, structural members that are the same as those of the ink cartridge 1 will be assigned the same reference numerals and an explanation thereof will be omitted.

Each of the plate members 3010 is a generally triangular shaped flat plate, and is provided on the lid 4 such that a plate surface of the plate member 3010 is orthogonal to the lid 4. More specifically, the plate member 3010 is a triangular thin plate member of which one angle is generally a right angle. The lid 4 has a lid main body 47 that has generally the same shape as the left wall 30 and a peripheral edge portion 48 that extends generally vertically from the peripheral edge of the lid main body 47, and that is fitted into the main body 3 (specifically, on the inner side of the bottom wall 31, the top wall 32, the rear wall 33 and the front wall 34). The plate member 3010 is integrally formed with the lid 4 such that, of the two sides of the plate member 3010 that form the generally right angle, the longer side is coupled to the inner surface of the lid main body 47, while the shorter side is coupled to a lower peripheral edge portion 49 of the peripheral edge portion 48. The lower peripheral edge portion 49 corresponds to the bottom wall 31. As a result, the diagonal side of the plate member 3010 is inclined from the inner surface of the lid main body 47 toward the lower left of the ink cartridge 3000. Thus, when the lid 4 and the main body 3 are joined together, the plate member 3010 does not obstruct the expansion and contraction deformation of the ink pack 7 due to the changes in the amount of ink.

The lower portion of the plate member 3010 protrudes further to the left, namely, in the direction of the main body 3 (refer to FIG. 3) of the housing 2, than the lower peripheral edge portion 49. When the lid 4 and the main body 3 are joined together, the plate member 3010 is disposed such that at least a part of the plate member 3010 is in a position between the engagement portion and the ink pack 7, in the direction in which the ink pack 7 and the detection plate 50 face each other (namely, in the left-right direction of the ink cartridge 3000). It is sufficient if at least a protruding end 3011 of the plate member 3010 is positioned between the engagement portion and the ink pack 7, in the left-right direction. Further, two of the plate members 3010 are provided such that they are separated in the longitudinal direction, on the lower end of the lid 4. The plate members 3010 are disposed in positions that are in the vicinity of the mounting plate portions 61 and separated by a certain distance from the mounting plate portions 61 in the front-rear direction, such that the plate members 3010 do not obstruct the movement of the detection plate 50 when the lid 4 and the main body 3 are joined together.

When an external impact is applied to this type of the ink cartridge 3000 due to being chopped etc., similarly to the above-described embodiments, the ink moves inside the ink pack 7 due to the impact.

Specifically, the ink moves suddenly upward or diagonally upward inside the ink pack 7. The sudden movement of the ink may pull the lower end portion 701 of the ink pack 7 diagonally upward. In the present embodiment, a portion near the protruding end 3011 of each of the plate members 3010, which are disposed between the ink pack 7 and the engagement portions in the left-right direction, can regulate the diagonally upward deformation of the lower end portion 701 of the ink pack 7. The plate members 3010 can inhibit the lower end portion 701 of the ink pack 7 from becoming trapped in the engagement portions. In the present embodiment, as the two plate members 3010 are provided such that they sandwich the mounting plate portions 61, it is possible to reliably inhibit the lower end portion 701 of the ink pack 7 from becoming trapped in the engagement portions.

As long as, when the lid 4 and the main body 3 are joined together, there is no obstruction to the deformation of the ink pack 7, such as expansion and contraction due to the changes in the amount of ink, and to the movement of the detection plate 50 due to the deformation of the ink pack 7, a member having another shape may be similarly arranged in place of the plate member 3010. For example, a trapezoidal flat plate, a rod-shaped member, or a plate member of which a plate surface is arranged parallel to the longitudinal direction of the lid 4 may be adopted. A member may be adopted that is a member whose main body extends in another chosen direction between the main body 3 and the lid 4. Further, the material of the member is not particularly limited, and as long as it is able to inhibit the lower end portion 701 of the ink pack 7 from deforming and moving to the engagement portions, the member may be formed from film, resin foam, sponge, a wood chip or the like. In this case, it is preferable for the film to have a rigidity at which it is not deformed when the lower end portion 701 of the ink pack 7 deforms and pushes the film when the ink cartridge 3000 receives an external impact.

The plate member 3010 may be formed as a separate member from the lid 4, and may be fixed to the lid 4. The one plate member 3010 only may be provided adjacent to the mounting plate portion 61 on one side. Even in this case, it is possible to reduce the likelihood of the lower end portion 701 of the ink pack 7 bending up due to the impact of being dropped and becoming trapped in the engagement locations of the mounting plate portions 61 and the shaft portions 54A and 54B. Three or more of the plate members 3010 may be provided.

Other than the above, the techniques disclosed in the above-described embodiments and the respective modified examples may be combined as appropriate.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An ink cartridge comprising:

a storage portion that has flexibility and that is configured to store ink;

a housing that covers the storage portion and to which at least a central portion of the storage portion is fixed;

a movable member that contacts with the storage portion in the housing, and that is rotatable in accordance with changes in a position of contact with the storage portion;

a support portion that is provided in the housing and that includes a pair of engagement portions, the pair of engagement portions being disposed at an interval therebetween and rotatably supporting the movable member; and an intermediate member that is disposed between the movable member and the storage portion.

2. The ink cartridge according to claim 1, wherein the intermediate member has flexibility, and at least part of the intermediate member is clamped between the movable member and the storage portion.

3. The ink, cartridge according to claim 1, wherein the housing includes:

a main body to which is fixed at least the central portion of the storage portion; and a lid, that is configured to be mountable on the main body, and the intermediate member extends between the main body and the lid.

4. The ink cartridge according to claim 1, wherein the intermediate member is disposed between the movable member and the storage portion and also between the support portion and the storage portion.

5. The ink cartridge according to claim 4, wherein the intermediate member is disposed between the storage portion and the pair of engagement portions.

6. An ink cartridge comprising:

a storage portion that has flexibility and that is configured to store ink;

a housing that covers the storage portion and to which at least a central portion of the storage portion is fixed;

a movable member that faces and contacts with the storage portion in the housing, and that is rotatable in accordance with changes in a position of contact with the storage portion;

a support portion that is provided in the housing and that includes a pair of engagement portions, the pair of engagement portions being disposed at an interval therebetween and rotatably supporting the movable member; and an intermediate member, at least one part of which is disposed between the storage portion and the support portion, in a direction in which the storage portion and the movable member face each other.

7. The ink cartridge according to claim 6, wherein the at least one part of the intermediate member is disposed between the storage portion and the pair of engagement portions, in the direction in which the storage portion and the movable member face each other.

8. The ink cartridge according to claim 7, wherein the housing includes:

a main body to which is fixed at least the central portion of the storage portion; and a lid that is configured to be mountable on the main body, the support portion rotatably supports the movable member on the lid side of the main body with respect to the storage portion, the intermediate member protrudes from the lid in a direction toward the main body, and at least a protruding end of the intermediate member is disposed between the storage portion and the pair of engagement, portions, in the direction in which the storage portion and the movable member face each other.

9. An ink cartridge comprising:

a storage portion that has flexibility and that is configured to store ink;

a housing that covers the storage portion and that includes an inner surface to which at least a central portion of the storage portion is fixed;

a movable member that contacts with the storage portion in the housing, and that is rotatable in accordance with changes in a position of contact with the storage portion;

a support portion that is provided in the housing and that includes a pair of engagement portions, the pair of engagement portions being disposed at an interval therebetween and rotatably supporting the movable member; and an intermediate member, at least one part of which is disposed between the storage portion and the support portion, in a direction that is orthogonal to the inner surface.

10. The ink cartridge according to claim 9, wherein the at least one part of the intermediate member is disposed between the storage portion and the pair of engagement portions, in the direction that is orthogonal to the inner surface.

11. The ink cartridge according to claim 10, wherein the housing includes:

a main body to which is fixed at least the central portion of the storage portion; and a lid that is configured to be mountable on the main body, the support portion rotatably supports the movable member on the lid side of the main body with respect to the storage portion, the intermediate member protrudes from the lid in a direction toward the main body, and at least a protruding end of the intermediate member is disposed between the storage portion and the pair of engagement portions, in the direction that is orthogonal to the inner surface.

* * * * *